US005800292A

United States Patent [19]

Brace

[11] Patent Number: 5,800,292

[45] Date of Patent: Sep. 1, 1998

[54] TENNIS COURT BOUNDARY DETECTION SYSTEM

[75] Inventor: Steven J. Brace, Canyon Country, Calif.

[73] Assignee: Steven James Brace, Santa Clarita, Calif.

[21] Appl. No.: 676,925

[22] Filed: Jul. 8, 1996

[51] Int. Cl.[6] ..... A63B 61/00

[52] U.S. Cl. ..... 473/467; 473/606

[58] Field of Search ..... 364/410, 411; 273/371, 372; 340/323 R; 473/467, 474, 470, 471, 472, 473, 570, 606

[56] References Cited

U.S. PATENT DOCUMENTS

| | | | |
|---|---|---|---|
| 3,774,194 | 11/1973 | Jokay . | |
| 3,854,719 | 12/1974 | Supran | 273/61 R |
| 3,883,860 | 5/1975 | Von Kohorn | 340/323 |
| 4,004,805 | 1/1977 | Chen | 273/29 R |
| 4,109,911 | 8/1978 | Van Auken | 273/31 |
| 4,299,384 | 11/1981 | Van Auken | 273/61 R |
| 4,365,805 | 12/1982 | Levine . | |
| 4,432,058 | 2/1984 | Supran | 473/467 |
| 4,433,840 | 2/1984 | Van Auken | 273/61 R |
| 4,664,376 | 5/1987 | Gray | 273/29 R |
| 4,664,378 | 5/1987 | Van Auken | 273/61 R |
| 4,718,670 | 1/1988 | Gray | 473/570 |
| 4,840,377 | 6/1989 | Bowser et al. | 473/467 |
| 4,855,711 | 8/1989 | Harrop et al. | 473/467 |
| 4,859,986 | 8/1989 | Van Auken | 340/323 R |
| 4,867,449 | 9/1989 | Carlton | 273/29 R |
| 5,059,944 | 10/1991 | Carmona | 340/323 |
| 5,150,895 | 9/1992 | Berger | 273/29 R |
| 5,303,915 | 4/1994 | Candy | 273/31 |
| 5,443,897 | 8/1995 | Kawaguchi | 428/237 |
| 5,489,886 | 2/1996 | Wexler | 340/323 |

OTHER PUBLICATIONS

Brace Detection Systems: An Investment Opportunity, by Steven J. Brace, May 1977,with photograph.

*Primary Examiner*—Jessica Harrison
*Assistant Examiner*—Marle A. Sager

[57] ABSTRACT

System for detecting whether a conductive felt covered game ball has landed within the boundary area of a gaming surface. The system incorporates permanently installed decorative circuits which stay in an active open state while awaiting touch down of conductive game ball. Completion or closure of active open circuit determines the ball in-bounds and thus still in-play. The control box will transmit a filtered signal to an audible tone or a wireless hearing aid designed for official use. Controversial opinions regarding continuation or elimination of the human element in officiating has allowed such a system to be designed which will initially aid officials and henceforth apply accruing detection modifications as these demands present themselves.

20 Claims, 18 Drawing Sheets

34

NOTES: (UNLESS OTHERWISE SPECIFIED)

1. ALL RESISTORS IN OHMS, 1/4W, 5%.
2. ALL CAPACITORS IN MICROFARADS.
3. A CONTACT CLOSURE ACROSS THE INPUT WILL RESULT IN A ONE SECOND ALARM BEEP.
4. S1 INCREASES THE INPUT CURRENT TO 20ms.

TENNIS COURT BOUNDARY DETECTION SYSTEM

BACKGROUND-FIELD OF INVENTION

This invention relates to an in-bound, electronic ball to court contact detection system, to aid officials in match-play.

BACKGROUND-DESCRIPTION OF PRIOR ART

A number of techniques have been designed to determine the location of a ball in relation to a boundary line, and also to determine whether a ball was in or out of bounds on a playing surface have heretofore been proposed.

This technique is of course inapplicable to clay court surfaces and grass court surfaces alike. Furthermore prior techniques are steadfast in eliminating the human element altogether, thus attempting to alter the deep tradition of tennis, and automate the officiating process completely.

Related approaches have not given the human official any credit whatsoever, by pursuing to detect balls that are up to 24 inches out and 24 inches in, this becomes an insult to the human line judge. One system of this character is disclosed in U.S. Pat. No. 4,859,986 issued Aug. 22, 1989, to John A. Van Auken for OBJECT TOUCHDOWN AND NET CONTACT DETECTION SYSTEMS AND GAME APPARATUS EMPLOYING SAME.

The attempt just discussed has the disadvantage as that eliminating the human element goes against the grain of the same thing they are trying to make obsolete, the human official. There is not a system that will extinguish the method of officiating in tennis, although this system proposes to do so. Initially, clay court tennis already has a method of determining the location of the ball. It is the only surface in which the rules state that the chair umpire, or the official in charge of the match has the right at the players request to get out of his chair and closely examine the "ballprint" that was left by the shot in question. This is a 99.9% fail-safe method, so why fix something that is not broken.

In fact, the just-mentioned system will incorporate a boundary line in theory that is 4 feet wide. The players or officials will not allow this, nor have they yet. The proposed electrical tape will change the texture of the playing surface, causing erratic bounces.

Also, the indicated embodiment requires the incorporation of a delay mechanism on those shots which hit the outer court first and then flatten or skid into the court playing area. This will delay detection which must be simultaneous, and enhance the complexity of the electronics, causing fallibility.

In addition, the temporary lines will eliminate the ability to play a doubles match immediately after a singles match, which happens quite often in a professional tournament.

Also, the International Tennis Federation are currently in discussion and very close to eliminating lets altogether. Thus making the net apparatus useless.

Optically based systems or systems using 20 or more cameras also have the disadvantage that it is not effective during night matches, since the lighting used will have a stroboscopic hindrance on the location.

Also, the reference method is too distracting during match play. During match play a line call must be determined simultaneously or within a fraction of a second of the landing of the ball so that play of the point can be continued or halted pending on whether the ball has landed within the boundary or not. This system will not allow a simultaneous call if the ball is close to being out but is still in play.

Plus, too much attention must be placed on a monitor and not the actual match itself. The official attending the monitor which provides the information can not be the chair umpire because it will divert too much of his attention to the monitor and not the actual match itself. And if another official must monitor the screen they will not be empowered to over-rule continuation or stoppage of play. In addition, this system is only replacing the linespeople with camera people, who will probably have little to no tennis knowledge. Not good for the tradition or promotion of good match play.

Furthermore, an instant replay type situation as what you may see in a professional football game, will not work in cooperation with a tennis match, the system is useful only for entertainment purposes only. Also, it is optically and visually impossible to determine an out ball that has just tagged the outside edge of the boundary and thus still in play.

Finally, this system can not determine a specific area on the court where lines adjoin together when one line is good and the other line is out, such as long serves on the sideline and doubles baselines during a singles match.

Thus, systems of the foregoing character, such as those disclosed in U.S. Pat. No. 5,489,886 issued Feb. 6, 1996, to Gil Wexler for AUTOMATIC LINE OFFICIATING SYSTEM AND METHOD THEREOF and the related video camera systems discussed in that patent, have not been accepted by the tennis world. Also, the concept to eliminate most if not all officials is unreasonable and will therefore be unsuccessful.

Yet another solution to the problem of close line calling involves the use of pressure sensitive switches on tennis court boundary lines to detect the touchdown of balls on those lines. Despite the claims made by the developers of such systems, they have proven incapable of dicriminating to an acceptable extent between the touchdown of a ball and the impact made if a player steps on the boundary line, even though relatively complex and costly discrimination circuits have been included in such systems.

Also, there is a distinct limit on the length which a pressure switch can have and still remain accurate. The numerous spaces between the switches are non active areas. Consequently, there are many areas on a court employing a pressure sensing line calling system which can not detect a ball touching down on the playing surface. One particular and critical circumstance of this character is at the outer edge of a boundary line. A pressure sensitive switch cannot detect with any degree of accuracy whether a ball lands on or just beyond the edge.

Furthermore, a contact which is sufficient for a ball to properly be called in bounds might not generate sufficient force to trigger a pressure sensitive device. In this circumstance, also, a system employing pressure sensitive devices would make the wrong call.

Thus, systems of the foregoing character, such as those disclosed in U.S. Pat. No. 4,365,805 issued Feb. 28, 1982, to Levine for SYSTEM FOR MONITORING TENNIS COURT BOUNDARY LINES and the related, pressure sensor systems discussed in that patent, are not being used by the tennis world.

Yet another touchdown sensing system heretofore proposed is that disclosed in U.S. Pat. No. 3,774,194 issued Nov. 20, 1973, to Jokay for GAME COURT BOUNDARY INDICATOR SYSTEM. In this system, a specially designed ball:"has an effect on a secondary antenna system" buried beneath the playing surface. This change in the antenna signal is detected and utilized to provide an indication that the ball touched down on a boundary line.

Tennis balls with the circuitry required to effect detectable changes in the signal received by a buried antenna system are impractical and would probably be quite expensive to manufacture for the time period that they would last.

A line calling system with similar objections uses the detection of a magnetic flux change to ascertain whether a ball lands out of bounds. Aside from being inaccurate, such a system would be difficult and expensive to maintain; and it is not even capable of determining if a ball came from across a net or simply bounced back onto the playing surface from an out of bounds location closely adjacent the boundary line.

Yet other hertofore proposed systems, such as Cyclops marketed in the United States by Essential Sports, Long Island, N.Y., rely upon the breaking of an infrared, visible light, or other beam spaced above the tennis court to predict whether a ball will land beyond the boundary line of a tennis court or other playing surface and therefore touch down out of bounds. Because it can be triggered by a player and a racket as well as a ball, the Cyclops system can be used only during the serve, and may only be used during singles matches to detect faults.

The system is currently being used at Wimbledon 1996, and from a television perspective it is calling good serves out, and out serves in, per John McEnroe and Dick Emberg. The players are not satisfied with the system, and the officials just turn their heads knowing there is a great injustice occurring. The officials realize if a human over-rule is implemented, the entire system will become useless.

Devices employing light beams are also difficult to maintain in alignment and notoriously inaccurate, particularly in the cases of high trajectory serves and of balls touching down at high speed and at a low angle. A ball of the just-mentioned character landing as much as two inches behind the outer edge of a boundary line may go undetected, and thus be determined good.

Variations in the contour of the court surface can also adversely affect the accuracy of the Cyclops system, or other line calling systems with a detector employing an energy beam.

The possibilities for misalignment also occur, causing postponement, to correct alignment.

In addition, only limited use can be made of such systems for another reason. The requirement for a detector at opposite ends of each boundary line precludes their use on the center service line and elsewhere on a tennis court, depending upon whether a doubles or singles match is in progress.

Yet other systems for eliminating the human element on whether a tennis ball has touched down in bounds are disclosed in U.S. Pat. No. 4,109,911 issued Aug. 29, 1978. Those systems include a network of parallel, spaced apart, exposed electrical leads extending along each of the tennis court boundary lines and a companion network of similarly related leads lying in the out of bounds area immediately adjacent to each boundary line. Alternate leads of each adjacent network are connected to an electrical power source, and the remaining leads are grounded.

A ball touching down in the out of bounds area immediately adjacent a boundary line may bridge two leads or conductors of the out of bounds network located in that area. This provides an indication that the ball touched down out of bounds.

While an improvement over other line calling systems, this system has its disadvantages and drawbacks. One is that it is less accurate than desirable because no effort is made to locate conductors precisely on the outer edges of the boundary lines. As a consequence, such a ball touching down and having a ballprint initially in an out of bounds area but then flattening out to the outer edge of the boundary line may not contact a boundary line-associated conductor. As a consequence, such a ball may be determined to be out of bounds even though it should have been called in, according with the official rules of tennis.

In addition, those techniques for providing conductor networks have been found to be less than entirely satisfactory. Conductive threads were found to be less durable than is desirable, and the electrical characteristics of those threads also left something to be desired.

Another significant disadvantage is that the players or officials can not selectively activate or deactivate the conductor networks associated with particular tennis court boundary lines. This function is a requisite in a practical system as different boundaries are employed during service, and singles or doubles play.

Several types of touch down sensing systems employing electrical conductors have been proposed-for example, in U.S. Pat. No. 3,883,860 issued May 13, 1975, to Von Kohorn for ELECTRICAL INDICATOR SYSTEM FOR BALL GAMES; 4,071,242 issued Jan. 31, 1978, to Supran for ELECTRICALLY CONDUCTIVE TENNIS BALL; and 4,299,384; 4,433,840; and 4,664,378, all issued to John A. Van Auken and respectively entitled ELECTRICALLY CONDUCTIVE GAME BALL, ELECTRICALLY CONDUCTIVE GAME BALL, and ELECTRICALLY CONDUCTIVE TENNIS BALL. Although theoretically sound like a great product, none of these systems ever panned out in the real world. Such systems could be used only once, and rarely even made it through an entire match. Thus, to make a system with accuracy and durability one must incorporate a structural engineer or find out what the people really want or perhaps both of these prerequisites. My own invention describes a system which is made of copperbar &fiberglass and is therefore capable of repeated use without damage to the system, but nevertheless all the boundary sensor systems heretofore known suffer from a number of disadvantages:

(a) Their manufacture of installation seems to remain a trade secret which they are not willing to share, or perhaps they had one only in theory. Such an element which is needed for the success of any and all boundary systems may have been a major flaw which led to difficulties with regard to the elimination of the human element in boundary detection.

(b) If one uses an out of bounds detection system concept it can only lead to good shots that are called out and out shots that will be considered good, with the different shapes and oblong configurations that the ball is subject to on the powerful shots the game is producing today. With the future holding a faster and faster game, more accuracy and durability must be the forefront of all practical considerations.

OBJECTS AND ADVANTAGES

Accordingly, besides the objects and advantages of the tennis court boundary detection system described in my above patent, several objects and advantages of the present invention are:

(a) to provide a system which can be differentiated from all previous claims in that the cosmetic appearance will enhance the outside edge of all boundaries with a golden outline;

(b) to provide a system lustrous to the naked eye, and economical to manufacture and install;

(c) to provide a system which is flexible toward the many different opinions of whether to eliminate the human official entirely or gradually reduce the officiating crews by modifications or additional detection easily adapted as automation becomes the trend;

(d) to provide a system which will incorporate similar surface texture;

(e) to provide a system whose accuracy can not be challenged;

(f) to provide a system which is dependable, will last the life of the court with no maintenance required;

(g) to provide a system which is suitable for both attended and unattended play;

(h) to provide a system which in tennis court applications, may readily be programmed to make calls appropriate to both singles and doubles play as well as the appropriate calls when the ball is served and when it is thereafter kept in play; and (i) to provide a system which is capable to determine an in bounds ball that has landed first on the outer court and after flattening or skidding touches the outer edge.

Further objects and advantages are to provide a system which can be used easily and conveniently to operate detection on different playing areas of the court, without attention loss or preoccupation of operation, and is easy to install with no maintenance required. Still further objects and advantages will become apparent from a consideration of the ensuing description and drawings.

BRIEF DESCRIPTION OF THE DRAWINGS

The above and other features, objects and advantages of present system will be understood more fully from the following description considered in connection with the accompanying illustrative drawings in which.

Figure 1:
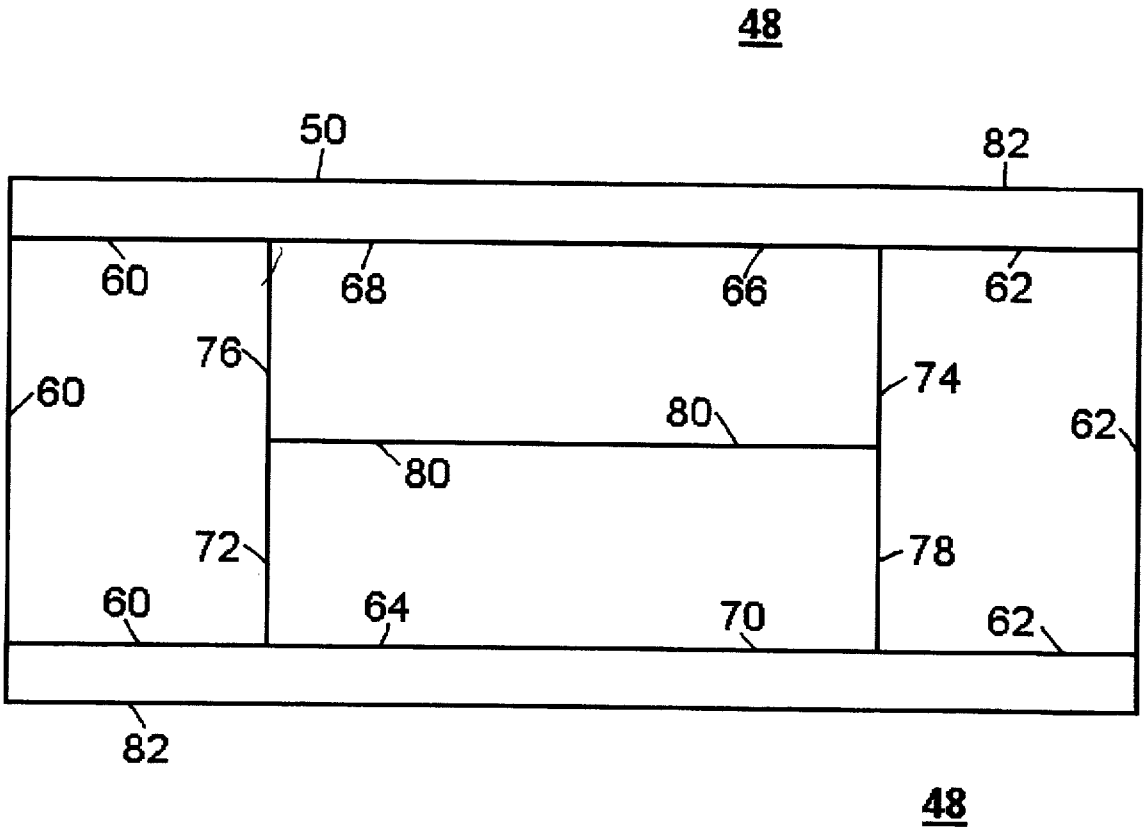
FIG. 1 is a standard tennis court with references indicating the different court circuits for different court areas for different progressions during match play.

REFERENCE NUMERALS IN DRAWINGS 20 center service line
22 boundary edge
24 control box
26 white court boundary line
28 45° angle cut in circuit
30 left back court
32 right back court
34 schematic; tennis ball alarm
36 right deuce court
38 right ad court
40 doubles courts
42 on/off switch
44 groove in court surface
46 below court surface
48 outer court
50 court boundary detection
52 connector plug
54 plug socket
56 connector cable
58 adhesive in groove
60 circuit #1 LSB&SL'
62 circuit #2 RSB&SL'
64 circuit #3 LDSL
66 circuit #4 RDSL
68 circuit #5 LASL
70 circuit #6 RASL
72 circuit #7 LDL
74 circuit #8 RDL
76 circuit #9 LAL
78 circuit #10 RAL
80 circuit #11 CSL
82 circuit #12 DB&SL'
84 a/c source
86 transmitter; antenna
88 speakers
90 hearing aid; headphone
92 sound waves
94 switch; doubles courts
96 switch; audio/hearing aid
98 rubber core of tennis ball
100 conductive tennis ball
102 conductive felt nap
104 outside insert
106 cut-out pattern for felt nap
108 gold plated exposed edge
110 singles court
112 upper angle view of circuit
114 end view of circuit
116 side view of circuit
118 top view of circuit
120 net
122 switch; serve/play #1
124 switch; serve/play #2
126 switch; serve/play #3
128 switch; serve/play #4
129 inside insert
140 insulator
154 left deuce court
156 left ad court

SUMMARY

A decorative, permanently installed boundary detection system, which includes court detection means, transmitter means, and conductive tennis ball means, for ball to court contact detect.

DETAILED DESCRIPTION OF THE PREFERRED EMBODIMENTS FIGS. 1–19

FIG. 1 shows a perspective view of a tennis court with boundary detection system incorporated into separate court areas to distinguish different court boundaries. The separate court areas are electronically divided to specify different playable courts during match play. The tennis court 50 is divided into twelve distinct and separate electronic circuits, thus enabling manual control over specified courts on certain points during the match. FIG. 1 shows the left singles baseline & sidelines, LSB&SL' 60, as a distinct and separate circuit through-out description. FIG.1 also shows the right singles baseline & sidelines, RSB&SL' 62, as distinct from all other circuits. Left deuce sideline, LDSL 64. Right deuce sideline, RDSL 66. Left ad sideline, LASL 68. Right ad sideline, RASL 70. Left deuce line, LDL 72. Right deuce line, RDL 74. Left ad line, LAL 76. Right ad line, RAL 78. Center service line, CSL 80. Doubles baselines & sidelines, DB'&SL' 82.

In this preferred embodiment, the boundary detection system 50 is installed on a tennis court. However, the boundary detection system 50 may be readily adapted to a variety of games requiring a ball court. The description hereupon assumes a boundary detection system configured on a tennis court, but the tennis court should be understood as only one possible embodiment of the boundary detection system 50.

Figure 12:
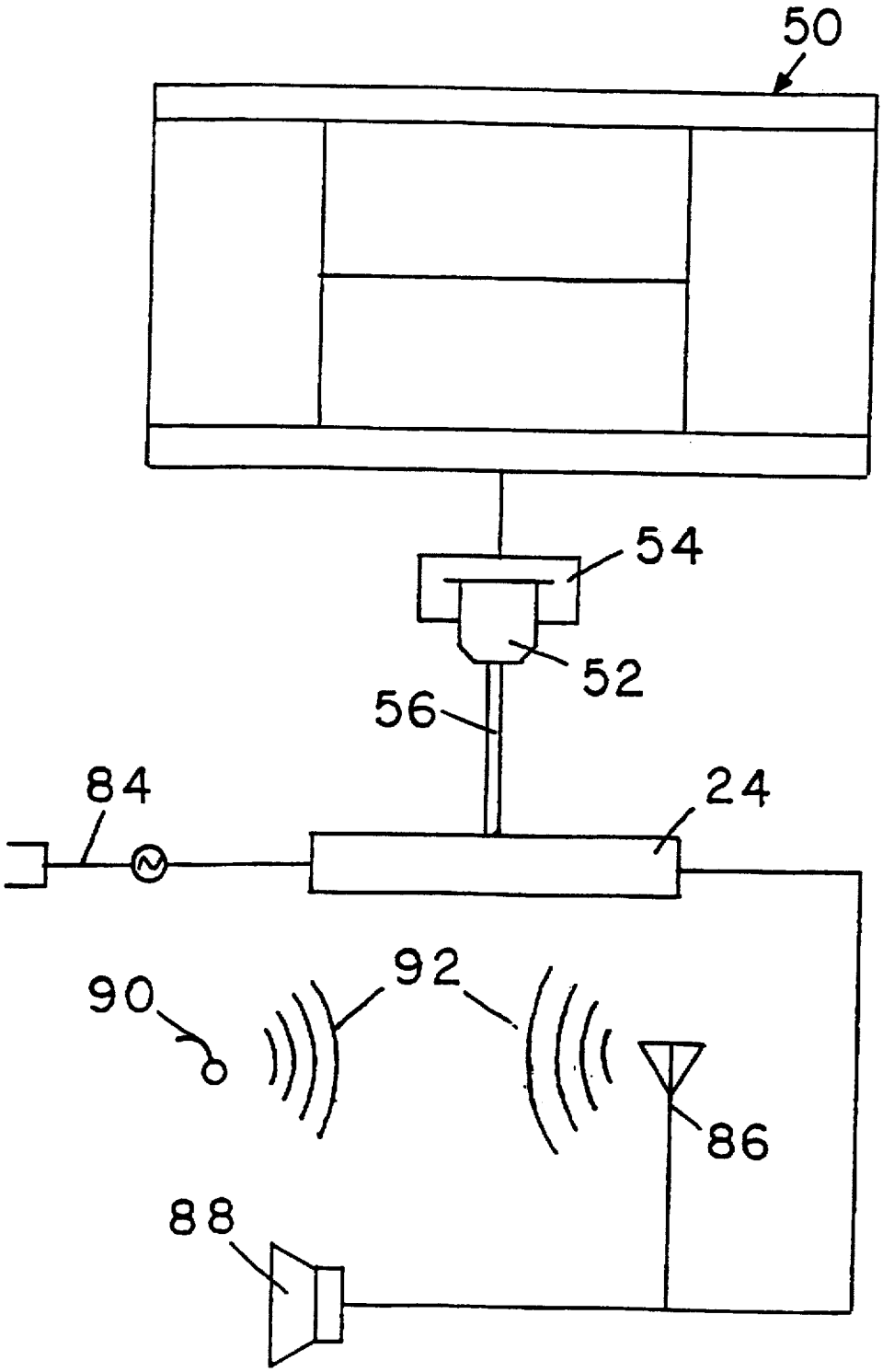
FIG. 12 is a view of the entire tennis court boundary detection system. Including the tennis court, connector means showing connector cable, control box, AC input, audible speaker, remote hearing aid complete with battery and receiver and finally transmitter in the form of an antenna for transmitting sound waves.
Figure 18:
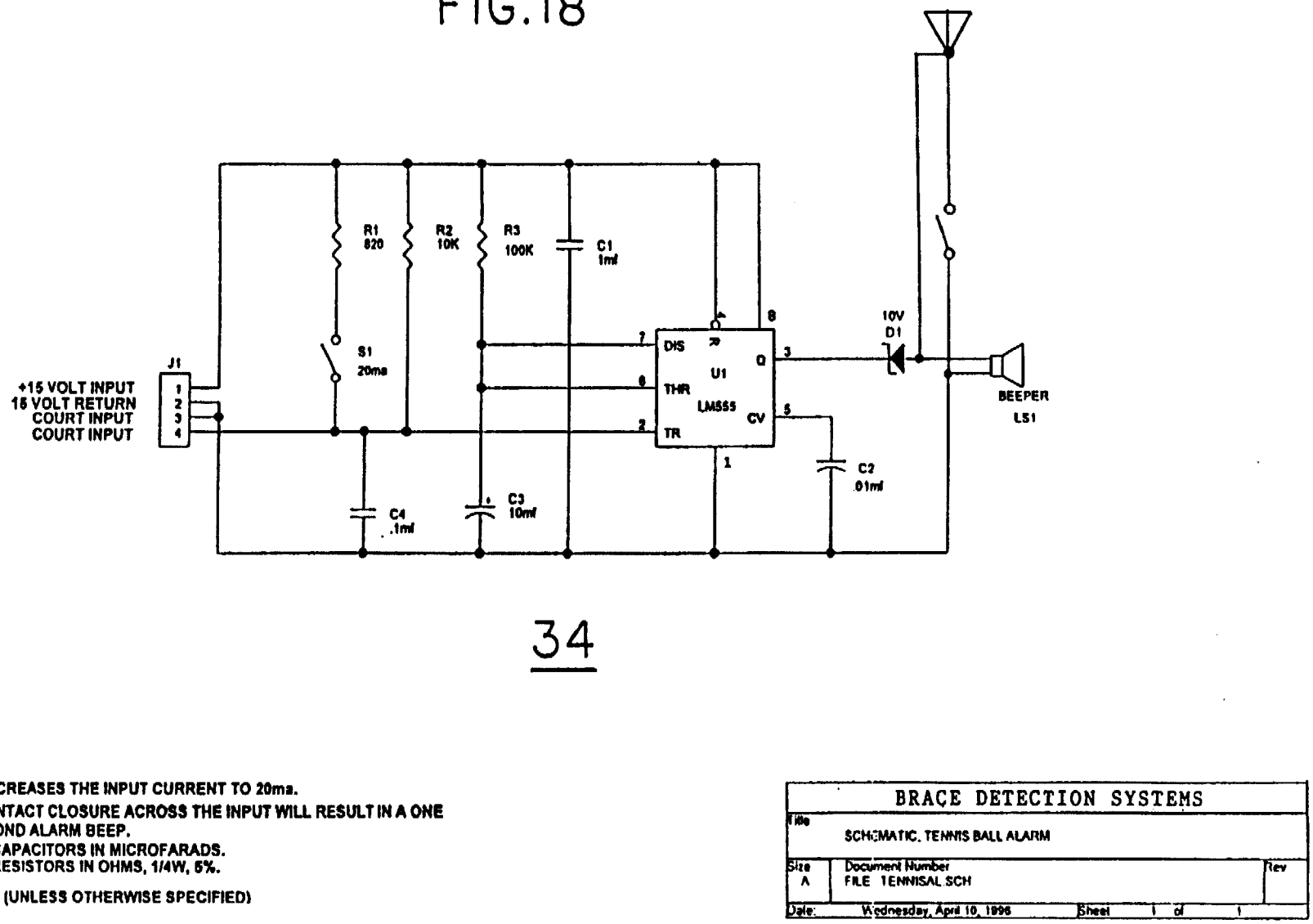
FIG. 18 is an electronic schematic comprising generic alarm circuit, incorporated in control box.

The boundary detection system 50 includes an open electronic circuit FIG. 18 which border the tennis court 50. Electronic circuits with reference numerals other than "50" are also shown in FIG. 1. However, it should be understood that these electronic circuits FIGS. 2 through 9 differ from each other only in their placement around the tennis court 50. The electronic circuits or inserts function in one pair or unit. A circuit comprises an insulator to separate circuit, thus rendering an open circuit as its normal state. The circuit is a contact device which include a means for transmitting and receiving radio waves, and a means for transmitting electronic impulses. One example of a means for transmitting and receiving radio waves is an antenna FIG. 12, 86 and a hearing aid or headphone 90, transmitting radio wave 92. One example for transmitting electronic impulses FIG. 12, 88 is at least one audible speaker connected to electronic circuit.

During play, contact circuits FIGS. 2 through 9 associated with tennis court boundary lines are in an open circuit state. For example, during singles play, only the contact circuits FIGS. 2 through 9 which parallel the singles baselines and sidelines are in an active open state. During service, certain baselines and sidelines are rendered in-active, while certain other service lines and center service line are in an active open state. FIGS. 14A–17B. For instance, when server takes first service position on left court baseline 60, and is serving into deuce court on right side the boundary areas are right deuce sideline 66 referred henceforth as RDSL, right deuce line 74 referred henceforth as RDL and center service line ref. CSL. Since the server is serving from the left court to the right court, his left singles baseline and sidelines 60 are in an active open state also, along with left deuce sideline 64 and left ad sideline 68. Once the good serve has commenced, the person operating the control box FIG. 19, moves switch 122 from the up position to the down position. The operator, be it the chair umpire or an alternate official, will have plenty of time to make the switch albeit he or she is watching the match as required. The official will be watching the match and already have a hand on control switch 122. There is no need to watch the switch being made, for they can do this by feel. Perhaps in between points (they have 20 to 30 seconds) they can glance down to find the correct switch, then continue to keep their eyes on the match, and operate the switch by feel. When it was mentioned that they will have plenty of time to make the switch, they will have from the time once the serve has landed, till the return of the return has landed to move one switch down (approx 2–4 seconds), thus turning the service lines off, and the sidelines and baseline on, FIG. 14B, until the completion of the point. This may sound confusing but in a real life situation it is quite simple. One switch before point starts, and one switch once the serve is in play. A manual control is the only logical way to control the certain court areas during certain progressions of a tennis match. There is no computer or automatic way to control what court areas are being played at what time. The particular characteristics and operation of each of these contact circuits will be more fully explained hereafter with references to FIGS. 14A–17B.

Normally the contact circuits FIGS. 2–9 are placed such that they are parallel and adjacent to the outside edge of the respective tennis court boundaries. Only on the outside edge of the service line is one distinct and separate circuit unto itself, thus having the entire service line an active open circuit during all four service positions FIGS. 14A–17A, 80.

Figure 11:
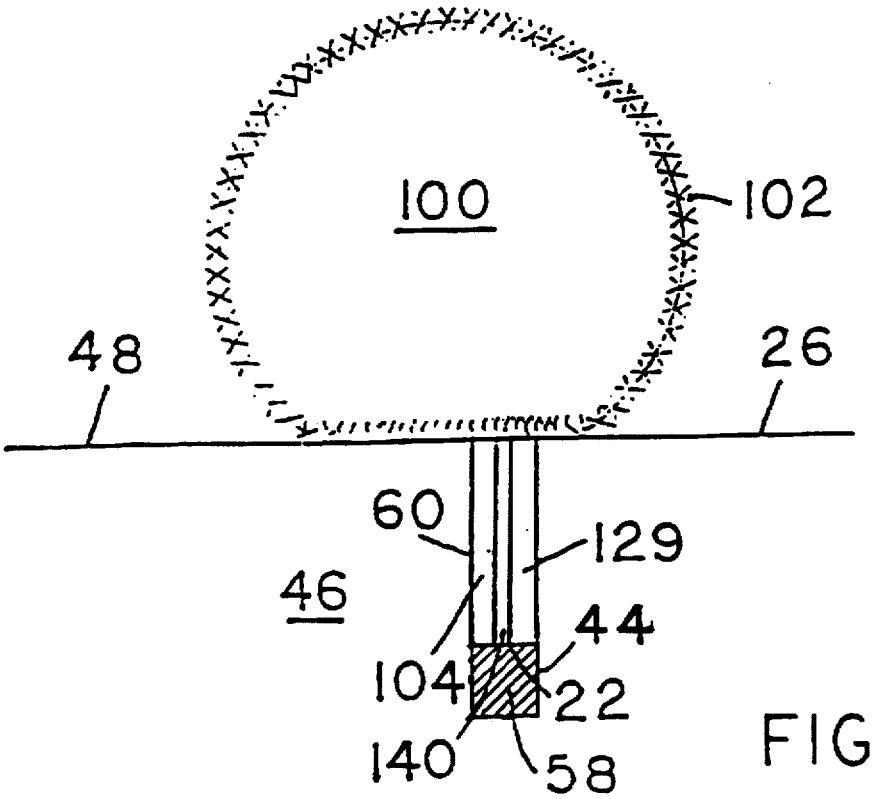
FIG. 11 is a diagram of an Officially Approved conductive tennis ball as it tags the far outside edge of court boundary, thus making the shot good and point continues.

FIG. 11 shows when an Officially Approved tennis ball 100, touches or closes circuit 60, it will cause detection in the form of contact within 0.003 seconds. This invention does not propose detection in the form of a visual signal, because the professional eyes officiating the match must keep their vision on the match at hand. There is no time during a point to be preoccupied with flashing lights. FIG. 12 shows the method of detection preferred in this embodiments audible sound 88 or in the form of hearing aids or head phones 90.

FIGS. 2–9B, show how the different circuits adjoin one another. Certain configurations that form a court area are electronically connected permanently, and certain configurations are separated by an insulator 140, to distinguish them from the adjoining circuit. The circuits are placed on the outside edge of all boundary lines, thus detecting in-balls in this preferred embodiment, illustrated in FIG. 11. However, in other embodiments of the boundary detection system 50, the contact circuits may be positioned around other portions of the tennis court.

Figure 2:
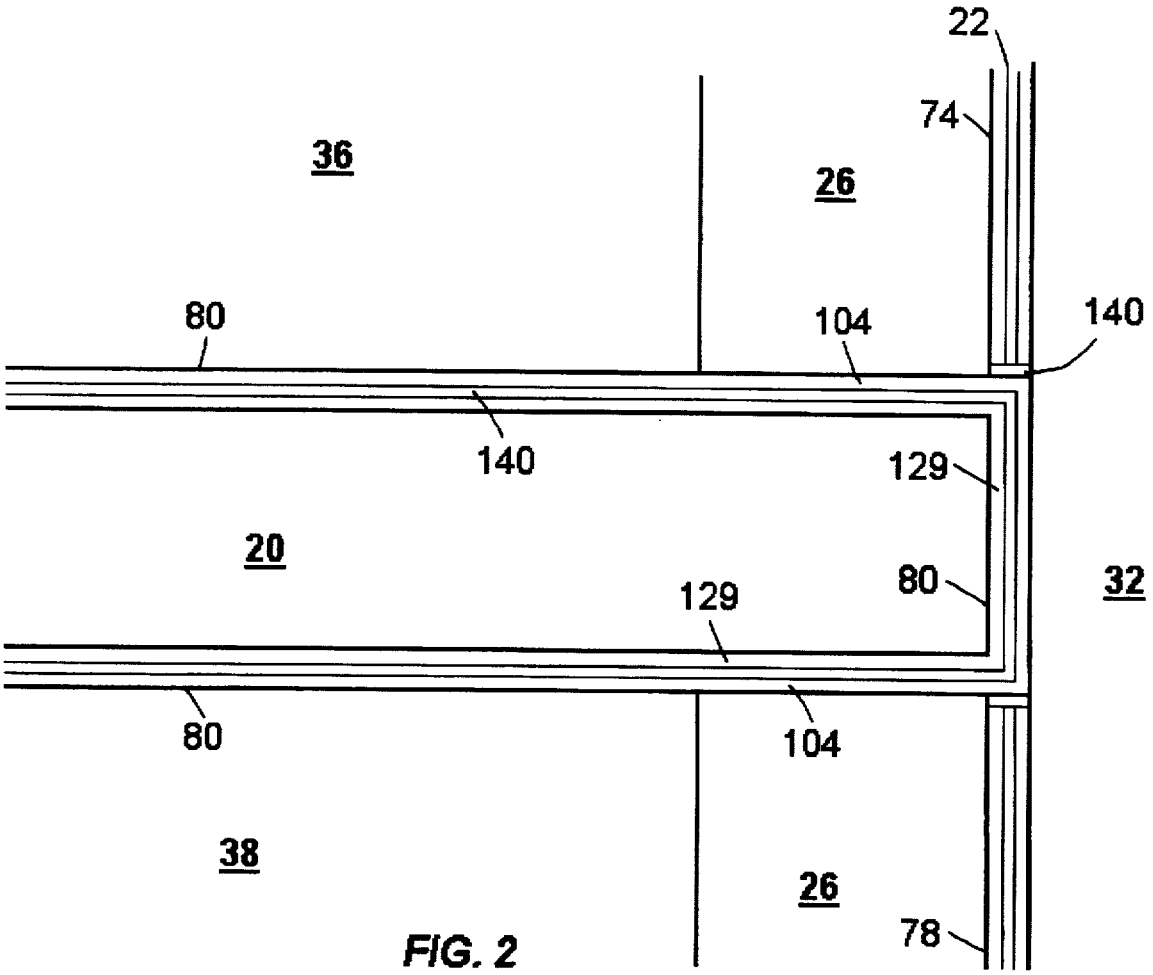
FIG. 2 is an actual size view of the right court service center line, splitting the upper deuce court and the lower ad court, incorporating the actual size circuit bordering the outside edge of disclosed lines,thus detecting in-balls.

Turning now to FIG. 2, an actual size view of the right court, center service line 20, bordered by right deuce court 36, and right ad court 38. The center service line 20 is divided by insulator 140, from both deuce court 36, and ad court 38, thus allowing their independent operation from each other. The inside insert 129, signifying the court boundary edge insert. The court boundary edge 22, thus signifying the end of the playable court, center service line 20, and the beginning of the outer court 32. The court boundary edge contact circuit for the center service line 80, is one circuit only, thus the entire service line will be in an active open circuit state during all four service positions, as illustrated in FIGS. 14A–17B. The logic of this is to eliminate complexity in the electronics, thus providing less fallibility. The simpler the electronics, the more infallible the system, which is a major prerequisite in developing a tennis court boundary detection system approved by players, officials and fans alike.

Figure 3:
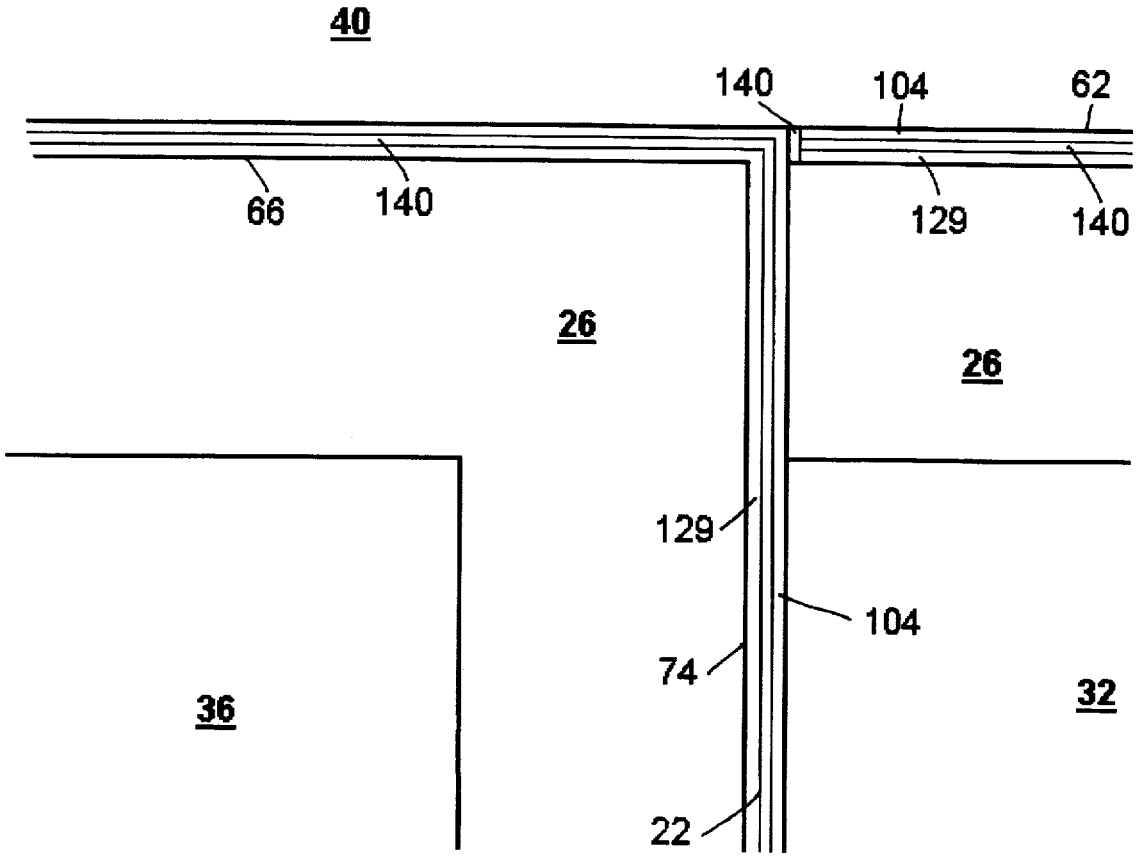
FIG. 3 is an actual size view of the right court deuce court. Including the far singles side sideline and the deuce court service line, incorporating the actual size circuit bordering the outside edge of disclosed lines, thus detecting in-balls.

Reviewing FIG. 3, and speaking of an in-bounds projected area indicated at 22 and inward therein. The detectable area being the outside edge of all boundary lines henceforth 66, 62 and 74. The officials will have a margin of error larger than the contact circuit area. Taking the trajectory flight of a typical shot, say on a serve over one hundred miles per hour, will stay in contact with the court surface for approximately 5cm–15cm, or 2–6", will give the official a 12" margin of error, depending on which side of the boundary edge contact circuit the ball lands on, thus eliminating the need to detect more surface area. This confirms the concept of detecting the outside edge of the boundaries only, thus not eliminating the human element, or the need of officiating crews to any degree. Still reviewing FIG. 3, it includes the right deuce court 36, the right back court 32, and the far doubles court 40, conjoining together in one court corner area. Pointing out the inside insert 129, the outside insert 104, the insulator separating the two inserts 140, the complete right deuce sideline, RDSL, contact circuit 66, the complete right deuce line, RDL, contact circuit 74, and the complete right singles baseline and sidelines, RSB&SL', 62. Also the white boundary line 26.

Figure 4:
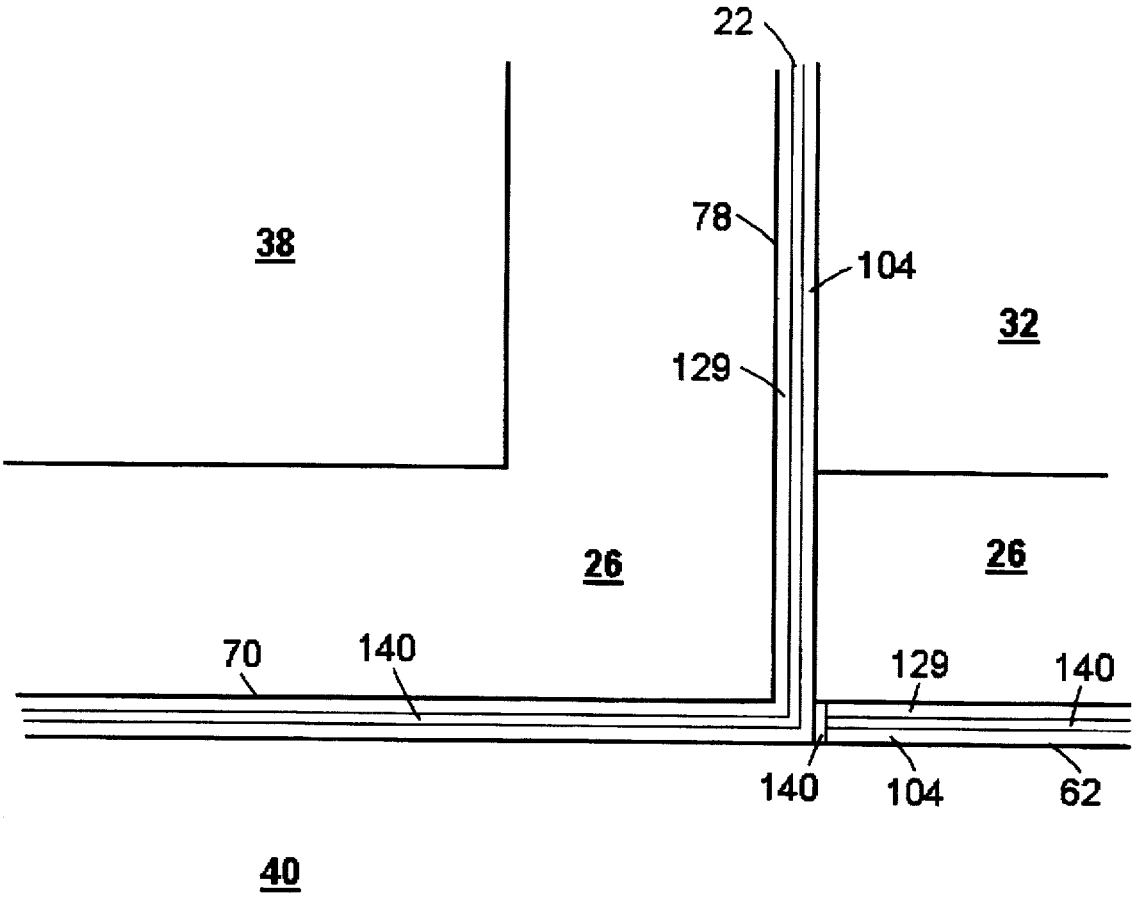
FIG. 4 is an actual size view of the right court ad court. Including the near singles sideline and the ad court service line, incorporating the actual size circuit bordering the outside edge of disclosed lines, thus detecting in-balls.

Reviewing FIG. 4, the right ad court 38, the right back court 32, and the near doubles court 40, conjoining together in one court corner area. Also signifying the inside insert 129, the outside insert 104, the insulator separating the two inserts 140, generally made from G-10 fiberglass for its lasting abilities, and the complete right ad sideline, RASL, contact circuit, with the right ad line, RAL, contact circuit 78, and the right singles baseline and sidelines, RSB&SL', contact circuit 62. Also the white; court boundary line 26. Also take note of the insulator 140, separating the RASL 70, and the RSB&SL 62, to distinguish circuitry.

Figure 5:
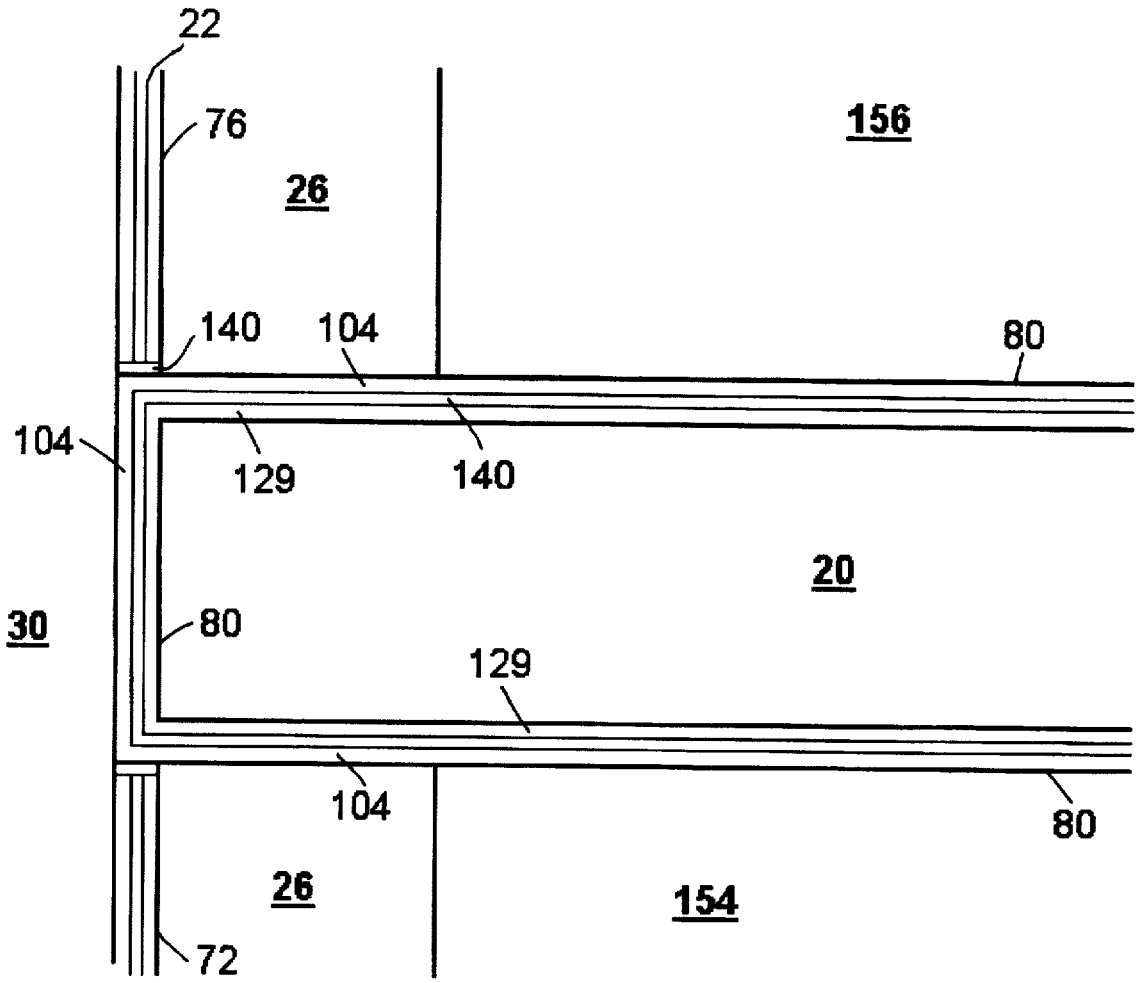
FIG. 5 is an actual size view of the left court service center line splitting the upper ad court and the lower deuce court, incorporating the actual size circuit bordering the outside edge of disclosed lines, thus detecting in-balls.

Now to explain FIG. 5, an actual size elevated view of the left court, center service line 20, bordered by left deuce court 154, and left ad court 156. The left service line 20, contact circuit 80, is divided by insulator 140, along with left ad line, LAL, and left deuce line, LDL, separated by the center service line, CSL, contact circuit, by insulator 140. Including also the left ad court 156, and the left deuce court 154, and finally the left back court 30.

Figure 6:
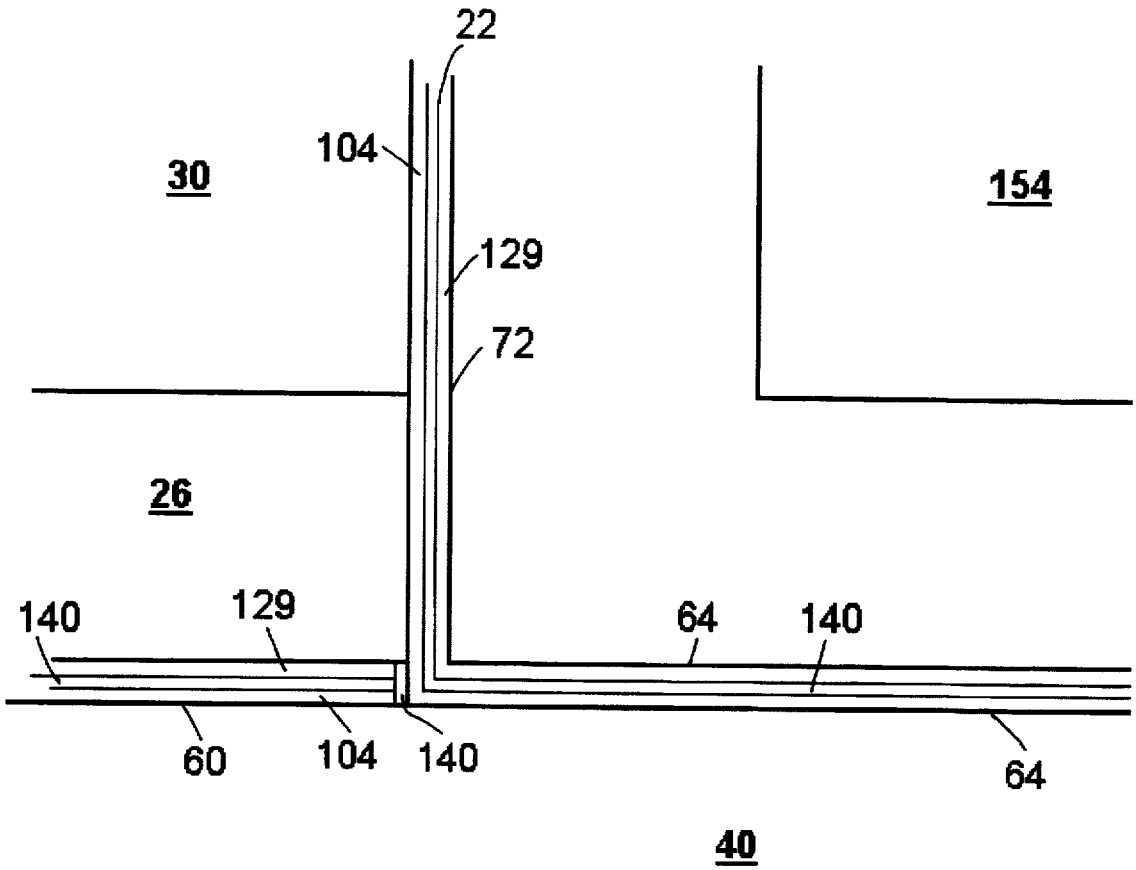
FIG. 6 is an actual size view of the left court deuce court. Including the near singles sideline and the deuce court service line, incorporating the actual size circuit bordering the outside edge of disclosed lines, thus detecting in-balls.
Figure 7:
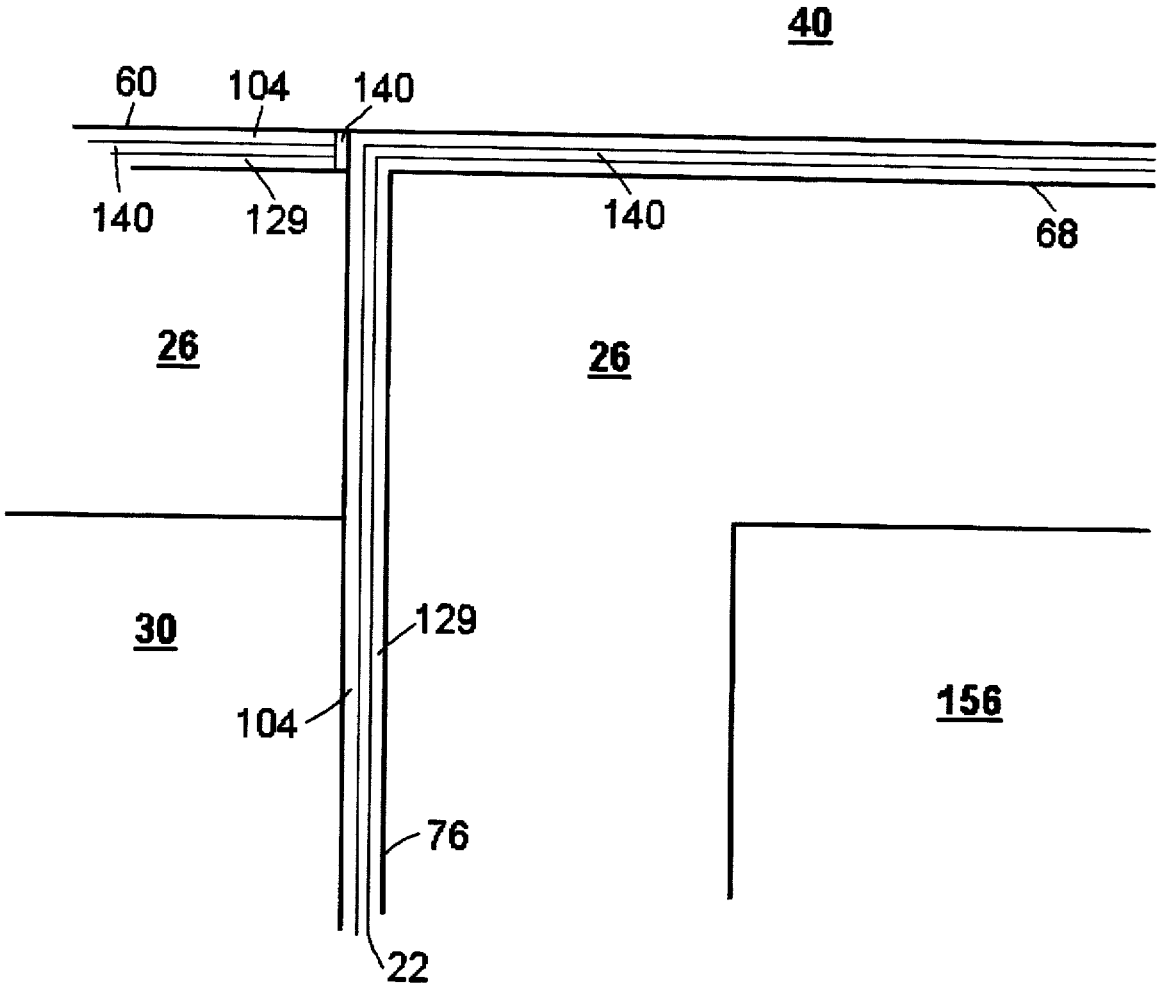
FIG. 7 is an actual size view of the left court ad court. Including the far singles sideline and the ad court service line, incorporating the actual size circuit bordering the outside edge of disclosed lines, thus detecting in-balls.

Now to explain FIGS. 6 and 7, which are quite similar in nature as FIGS. 3 and 4, except they cover the opposite side of the court. Again an actual size elevated view of the left court deuce court FIG. 6, 154, and the left court ad court FIG. 7, 156. They incorporate the inside insert 129, the outside insert 104, divided by the insulator 140, also the insulator 140, separating court contact circuits LSB&SL 60, and LDSL 64. These figures also include the outer courts 40, which are the doubles courts in this particular diagram during singles play. Both diagrams display the left back courts 30, and the white court boundary lines 26.

The width of the inserts 104, 129 and the width of the insulator 140, comprising the court contact circuit 60, 62, 64, 66, 68, 70, 72, 74, 76, 78, afid 80, in FIGS. 2–9B, required in the disclosed preferred embodiment, and thus the number of court contact circuits to run parallel with court boundary, will ultimately be decided by the players and officials involved in the sport. However, this the one preferred embodiment that will allow the officiating teams to continue their roles as tradition will have it, and satisfy the players inquiries as to whether their hard earned shot has tagged, ever so slightly, the outside edge of the boundary, thus constituting a good shot.

Figures 8A, 8B:
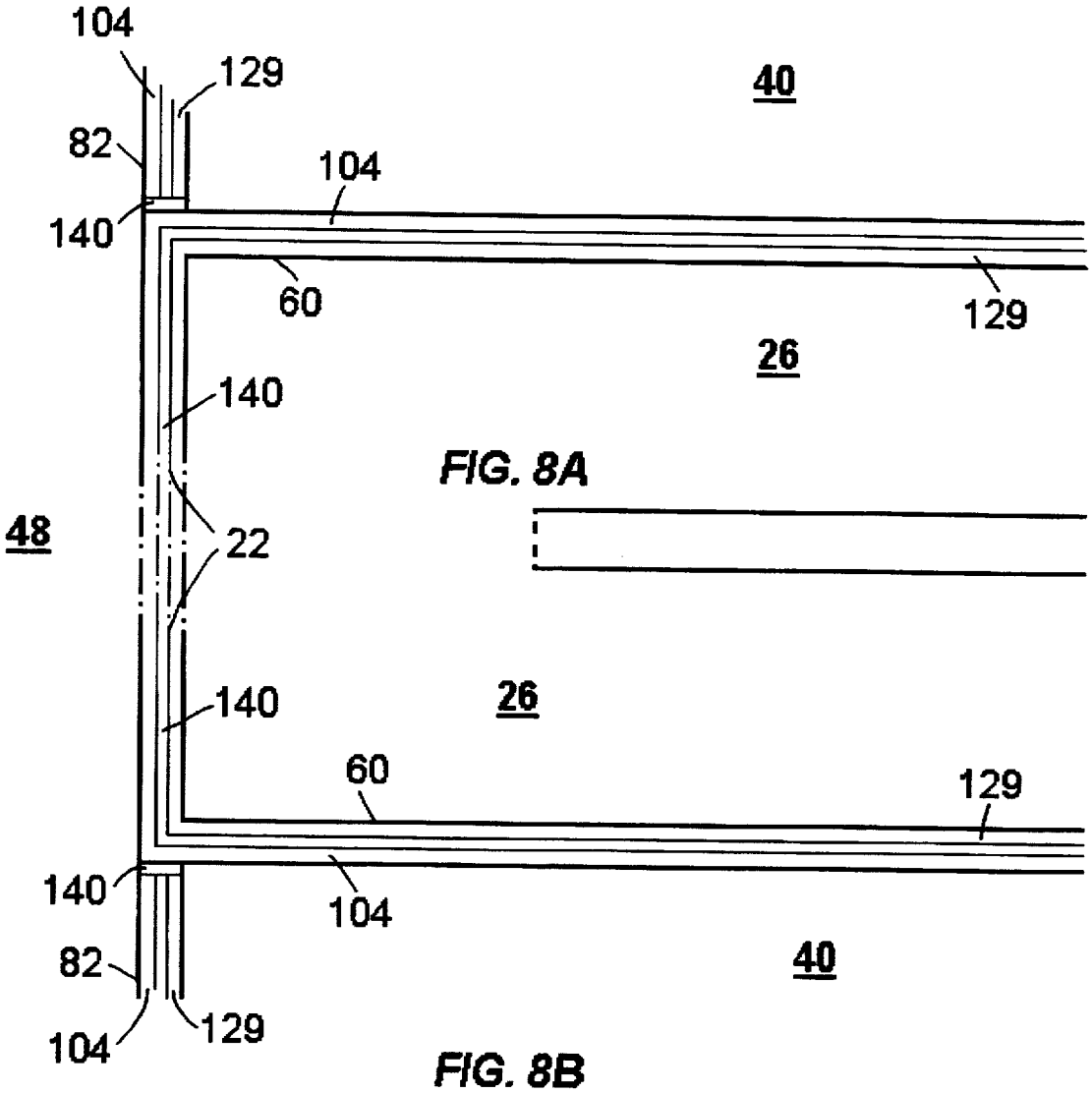
FIG. 8A is an actual size view of the left court baseline, sideline and doubles baseline. Including the far singles sideline, singles left baseline and left doubles baseline, incorporating the actual size circuit bordering the outside edge of disclosed lines, thus detecting in-balls.
FIG. 8B is an actual size view of the left court baseline, sideline and doubles baseline. Including the near singles sideline, singles left baseline and left doubles baseline, incorporating the actual size circuit bordering the outside edge of disclosed lines, thus detecting in-balls.
Figures 9A, 9B:
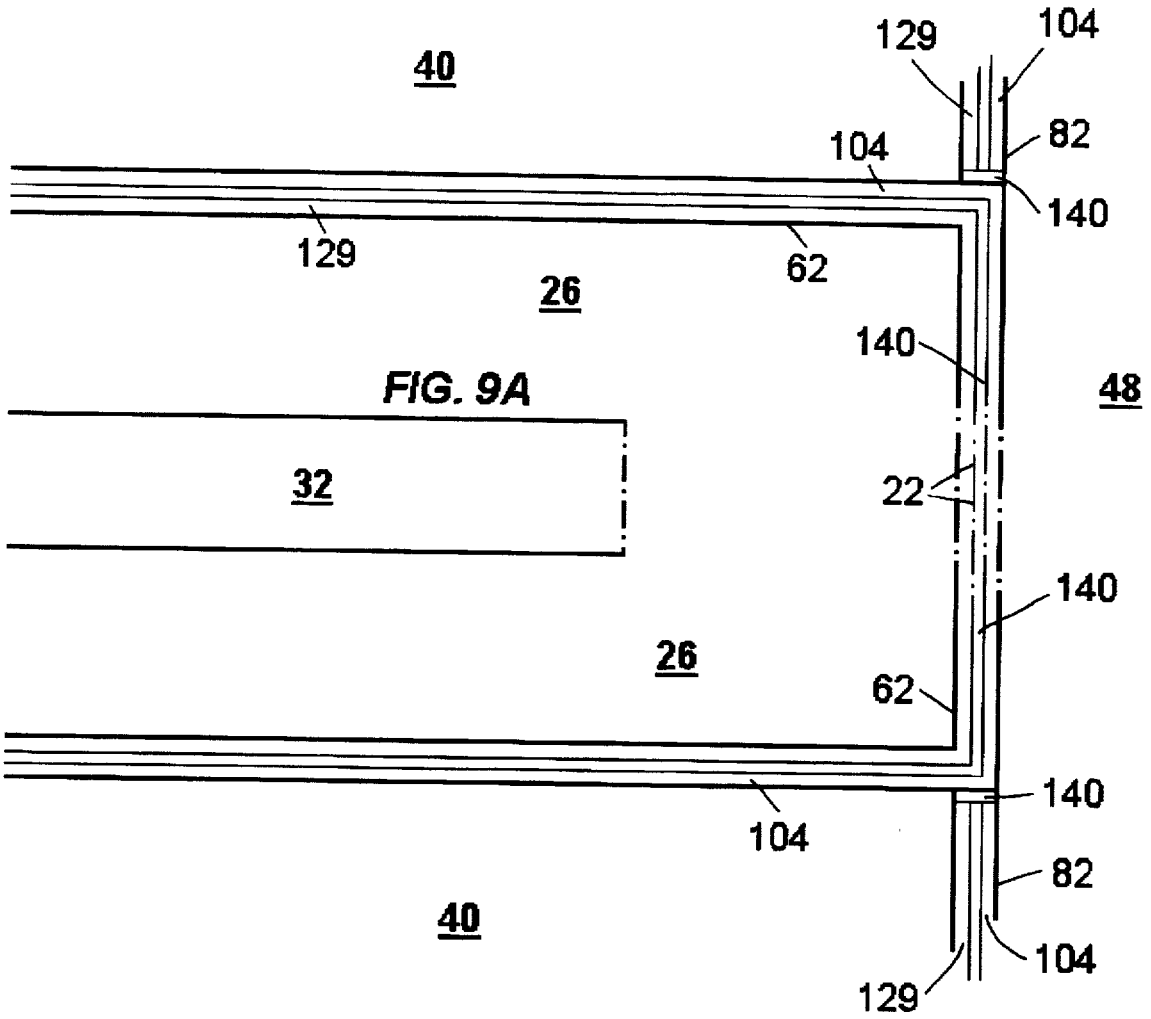
FIG. 9A is an actual size view of the right court baseline, sideline and doubles baseline. Including the far singles sideline, singles right baseline and right doubles baseline, incorporating the actual size circuit bordering the outside edge of disclosed lines, thus detecting in-balls.
FIG. 9B is an actual size view of the right court baseline, sideline and doubles baseline. Including the near singles sideline, singles right baseline and right doubles baseline, incorporating the actual size circuit bordering the outside edge of disclosed lines, thus detecting in-balls.

Examining FIGS. 8A–9B, will allow the reader to observe left singles baseline and sidelines, LSB&SL' 60, and right singles baseline and sidelines, RSB&SL' 62. Also included in diagrams are both doubles baselines 82, in both diagrams. Incorporated in both diagrams are outside insert 104, inside insert 129, insulators 140, court boundary edges 22, outside court 48, and in FIGS. 8A–8B is left back court 30, court contact circuits 60 and 82, also white court boundary lines 26, and doubles courts 40. In FIGS. 9A-9B is right back court 32, court contact circuits 62 and 82, also white court boundary lines 26, and doubles courts 40. It should be noted, that in FIG. 13D, 28, is an example of a 45° angle cut on FIGS. 2–9B contact court circuits 60, 62, 64, 66, 68, 70, 72, 74, 76, 78, and 80, will incorporate FIG. 13D, 45° angle cuts 28. However some angle cuts will constitute a distinct and separate circuit, and some will incorporate a complete circuit. For example, FIGS. 2 and 5 which show the center service line, incorporates a complete circuit around the entire center service line, CSL, as the right court service center line has an active open circuit, so does the left court service center line have an active open circuit. The reason for this is to simplify electronics, as explained earlier in description. On LSB&SL' 60, and RSB&SL' 62 is also incorporated a complete circuit, thus activating the baseline and sidelines simultaneously on each side respectively. Now referring to FIGS. 3, 4, 6, and 8, court contact circuits 66, and 74 constitute distinct and separate circuits thus allowing individual operation of themselves. Also circuits 70, and 78 operate individually of each other. Circuits 64, and 72 operate individually and circuits 68, and 76 operate individually, even though they are conjoined together with a 45° angle cut.

The detailed implementation of one preferred embodiment of the actual installation can be more fully understood by referring to FIG. 11. The surface and below the surface 46, is a concrete slab. Accordingly, the concrete slab is approximately 10 cm. thick, or 4". It consists of cement and approx. 5 cm. below the surface is a strengthener in the form of "rebar" or iron rods that criss-cross to make a net of the bars. The groove 44, which accommodates the contact court circuits, discussed above, will be made by a concrete "flat saw". The "flat-saw" is powered by a 35 H.P. gasoline motor. After snapping a red chalk line, parallel to the boundary edge, a clear waterproof spray is applied over a red chalk mark, thus keeping it visible during entire cut. All "flat saws" are equipped with a built in water dispenser to provide a steady water flow to the surface to be cut. All concrete cuts are made with water, to hold down the temperature and produce "slurry", which is easily vacuumed up immediately following the cut. The depth of the cut in this embodiment is 4 cm or 1.5" 44. After marking the court with chalk a "diamond blade" equipped with the saw and the guide line, also part of the saw, will be lined up with chalk-line. This process is a two man job, taking approx. 2–3 hours to perform, or 2.5 meters per minute. The total length of groove to be cut is 146.3 meters, or 480 feet, the total length of all boundary lines on a tennis court. The operators need to equip themselves with rubber boots, gloves, ear plugs and protective glasses. With each corner cut the operator needs to over-cut the groove by half the diameter of the blade, to assure proper depth for the entire length. The operators will make one pass at 4 cm. One professional company that will perform the cutting is Penhall Company 1801 Penhall Way Aneheim, Calif. 92801.

Also referring to FIG. 11 is an end view of the cut-out groove 44 and the adhesive 58 in the form of epoxy, that will fill the groove 44 and act as a base to eliminate sinkage of the circuit 60, and to prevent the circuit 60 from moving up in the groove 44. A side view of the concrete slab below the surface 46, shows the width and depth proportions 104, 140 and 129, shows the width and 44 shows the depth. Exact measurements will be discussed next when the circuit is examined. Also in FIG. 11 is a side view of Officially Approved tennis ball 100, along with the conductive felt covering 102, adhered to rubber core 98, making the entire surface of the tennis ball 100 electronically conductive.

Figure 13A:
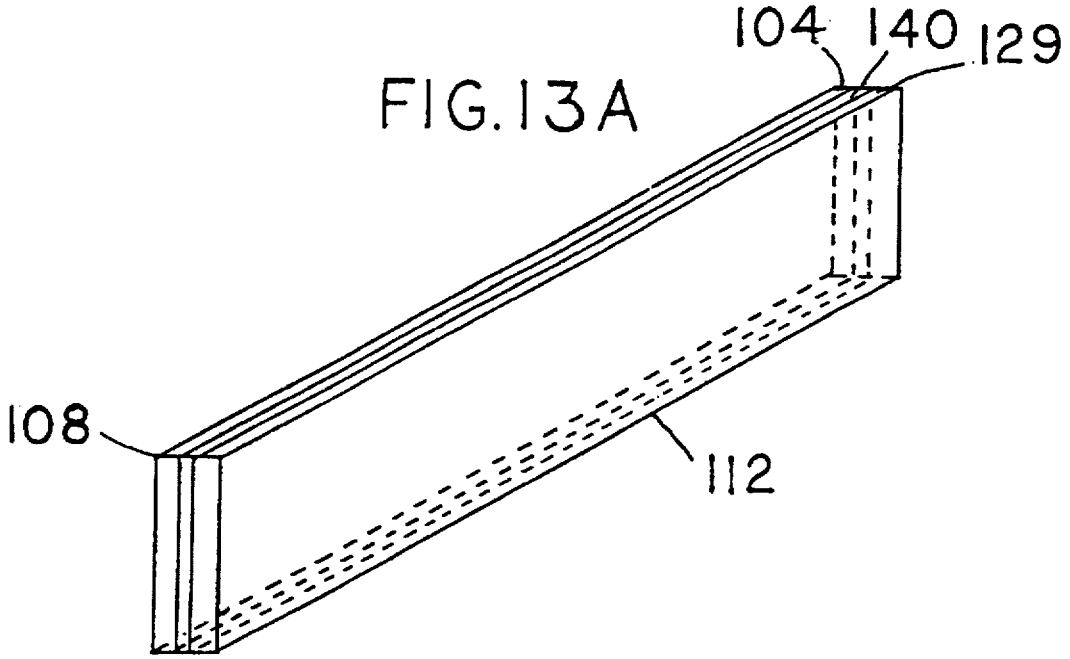
FIG. 13A is an upper angle view of court detection means, generally comprised of two copper bar inserts, separated by insulator, generally comprised of G-10 fiberglass.
Figure 13B:
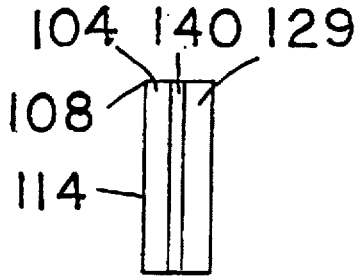
FIG. 13B is an end view of court detection means, copper insert or electronic circuit.
Figure 13C:
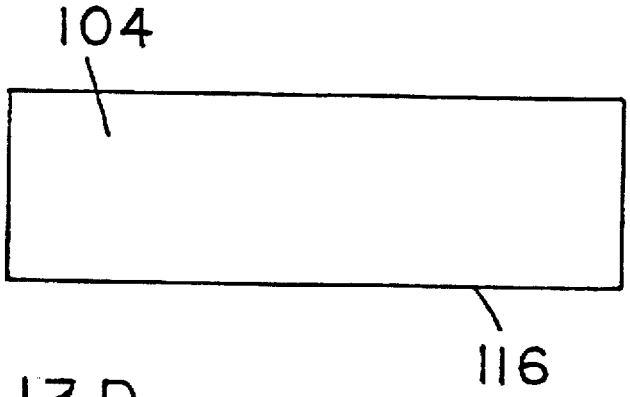
FIG. 13C is a side view of court detection means, copper insert or electronic circuit.
Figure 13D:
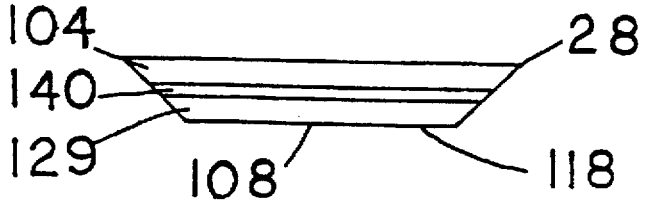
FIG. 13D is a top view of court detection means, copper insert or electronic circuit, incorporating 45° angle cuts for corner installation on specialized court areas, such as center service line (both ends), service court lines with singles sidelines (four locations), singles and doubles lines incorporating eight locations where sidelines and baselines adjoin.

Turning now to FIG. 13A–D, an actual size portion of the court contact circuit 112 is shown in an upper angle view. The precise measurements of inside insert 129 is 0.3175 cm or 3.175 mm or 0.125" or ⅛ of an inch. The outside insert is the same thickness. The insulator is 0.15875 cm or 1/16 of an inch. The total thickness of the court contact circuit 112 is 0.79375 cm or 5/16 of an inch. FIG. 13B shows an end view 114 of court contact circuit, including all three pieces, the inside insert 129, the insulator 140, and the outside insert 104. FIG. 13C is an end view 116. FIG. 13D shows a top view 118. The court contact circuit in this embodiment is made from copper buss, bar SE 110 part # CU012100, purchased from Industrial Metal Supply Co. 3303 North San Fernando Blvd. Burbank, Calif. 91504. The inserts 112, 114, 116 and 118 are plied together with the insulator 140 separating the two inserts 129 and 104 with epoxy assuring a strong long lasting bond. The circuits 112, 114, 116 and 118 once they are plied together are sent through a standard industrial mill to produce the exact lengths necessary. Also to produce the precise texture on the exposed edge 108, and the precision 45° angle cut, the industrial mill will be utilized. A preferred place is Canyon Welding 26782 Oak Avenue, Canyon Country, Calif. 91351. The exact thickness of the circuit 112, will be the exact width of the groove in the concrete, 0.79375 cm, to assure a tight, permanent, long lasting fit, which will stay embedded in the court for many years, with no maintenance required. Once the exposed edge 108 has been milled, there is a process called electroplating that will be performed on the exposed edge 108. The reason for this process is to eliminate weathering or tarnishing or oxidation on the copper inserts. A preferred place for this process is Alert Electroplate in North Hollywood, Calif. The electroplating process will be done with a gold electroplate fifty millionths of an inch thick. Gold is the best conductor known to man, and does not tarnish or oxidize. The gold electroplate will be of a 24 carat nature.

Figure 10B:
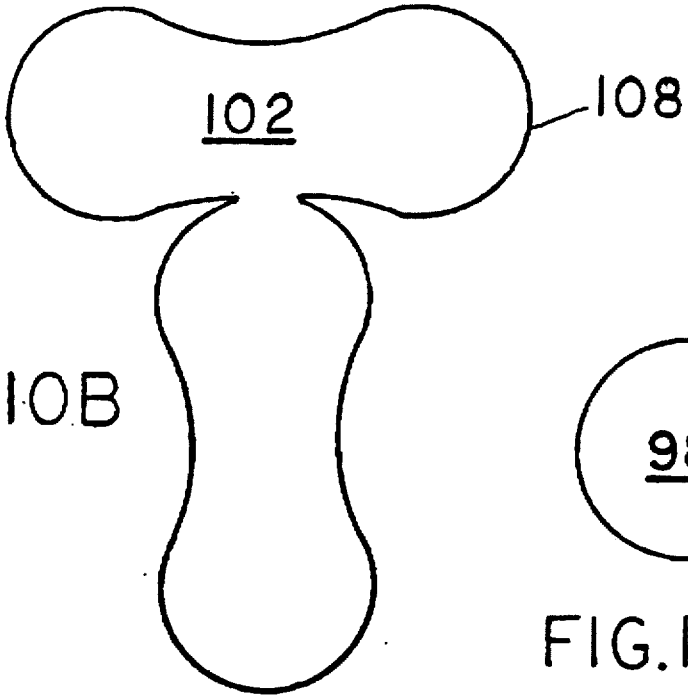
FIG. 10B is a view of Officially Approved conductive felt covering or nap that will be adhered to Officially Approved rubber core, thus constitutes Officially Approved tennis ball.
Figure 10A:
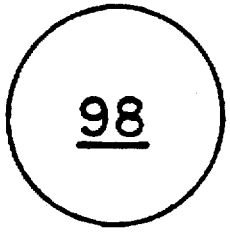
FIG. 10A is a diagram of the rubber core that constitutes ingredient for making Officially Approved tennis ball.

Referring to FIG. 10A–B is a view of the Officially Approved rubber core 98 and the Officially Approved conductive felt nap. A company called Toli Corporation 13–1, Toranomon 1-Chome Minato-Ku, Tokyo 105 Japan, will be producing the Electrically Conductive Decorative Material. They will produce a fiberous e.g. fabric textile layer material. It will simulate blended slivers of wool and nylon fibers so that the component fibers of the blended sliver extend as pile fibers on one surface. The free piles extend respectively at different maximum inclinations in the range of 0° to 90° to cover the surface of the base portion. The amount of wool or simulated wool fiber is approximately 75% by weight, and the nylon or simulated nylon is approximately 25% by weight.

According to FIG. 10B the aforementioned Electrically Conductive Decorative Material or the Officially Approved felt nap 102 will be durable and lasting. The optic yellow fibers which constitute the conductive felt nap 102, will be laminated to a flexible polymeric layer, which will then be heatpressed around the Officially Approved rubber core. Thus making an Officially Approved, optic yellow, conductive tennis ball. The conductive tennis ball will have the capability to complete an open electronic circuit of 12 VDC @ 15 mA. infallibly, which will be mentioned in detail later.

The embodiment of the entire tennis court boundary detection system may be viewed in FIG. 12. It constitutes where the boundary detection system will be installed on the court 50, how and where the detection signal will be transmitted 52, 54, and 56, the source of electricity 84, how the electricity is filtered 24, and what forms the detection signal will be delivered in 86; 88. Starting with where the detection system will be installed on the court 50, parallel with the outside edge of each and every boundary line that make up a tennis court. Thus detecting balls that are still in-play. The active open circuit which will be the normal state of the circuit on boundaries that are being played into, will be closed or cause detection in the form of contact, and transmit signal through a connector plug 52 and connector cable 56. The connector plug 52 consists of 25 distinct and separate female pins, which will couple to the male connector plug installed in the plug socket 54. The male plug will have 24 lead wires of 22 gauge insulated lead wire soldered to the lower portion of each distinct and separate insert. Thus determining the active open circuit mentioned earlier. The female connector plug 52 coupled to the connector cable 56, will lead to another female connector plug, not shown, that will couple to the control box 24. The control box 24 consisting of generic alarm circuit, explained later, will transform power source 84 into a transmittable signal for ball to court detection in the form of contact. A stand-by generator will be at hand if power source 84 failure should occur. The signal will be transmitted to either an audible tone sent through speakers 88 placed strategically around the outer court area, for singles or doubles play with no officiating. Or the signal will be transmitted to a hearing aid device 90 equipped with battery and receiver for official match play. The hearing aid device 90 will receive signals 92 sent through an antenna 86 with a 900 milli Hertz transmitter using the same concept as the wireless headphones currently on the market. The line officials and chair umpire will each wear a hearing aid in one ear, and will continue to have the mobility that is necessary to officiate a tennis match. Using a hearing aid 90 in this manner will allow the officials to use their hearing ability along with their visual ability to officiate the match, thus no hindrance to their duties what-so-ever.

Reference is now made to FIG. 18, the tennis ball alarm schematic 34. This alarm circuit 34 is a generic electronic circuit known world wide, any person skilled in the art will be familiar with the technology applied. The circuit may be modified in several different ways to appropriate the result desired. Currently, upon closing of the circuit or landing of the ball, detection in the form contact will signal alarm circuit simultaneously causing a tone lasting approximately 0.75 seconds. The length of the tone may be varied.

While the above detailed description has shown, described, and pointed out, the fundamental novel features of the invention as applied to various embodiments, it will be understood that various emissions and substitutions, and changes in the form and details of the device illustrated, may be made by those skilled in the art without departing from the spirit of the invention.

OPERATION—FIGS. 14, 15, 16, 17, and 19

Figure 14A:
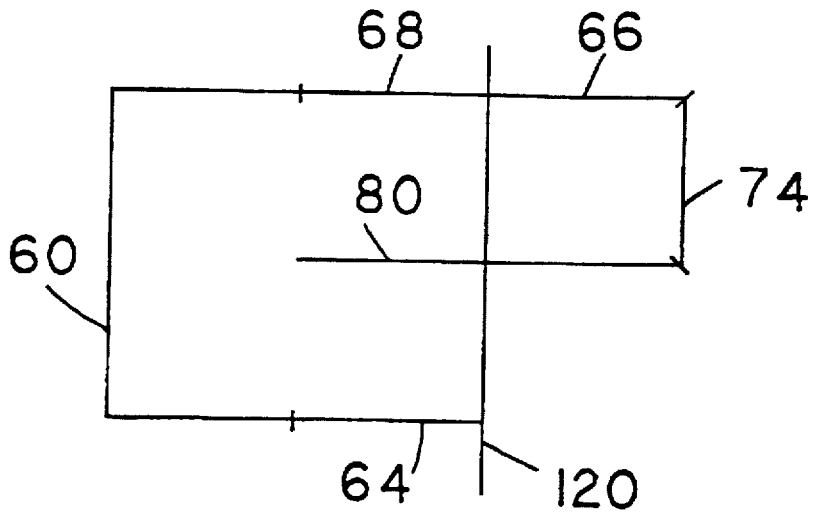
FIG. 14A is a view of the first service position. Including shown court areas currently being detected.
Figure 14B:
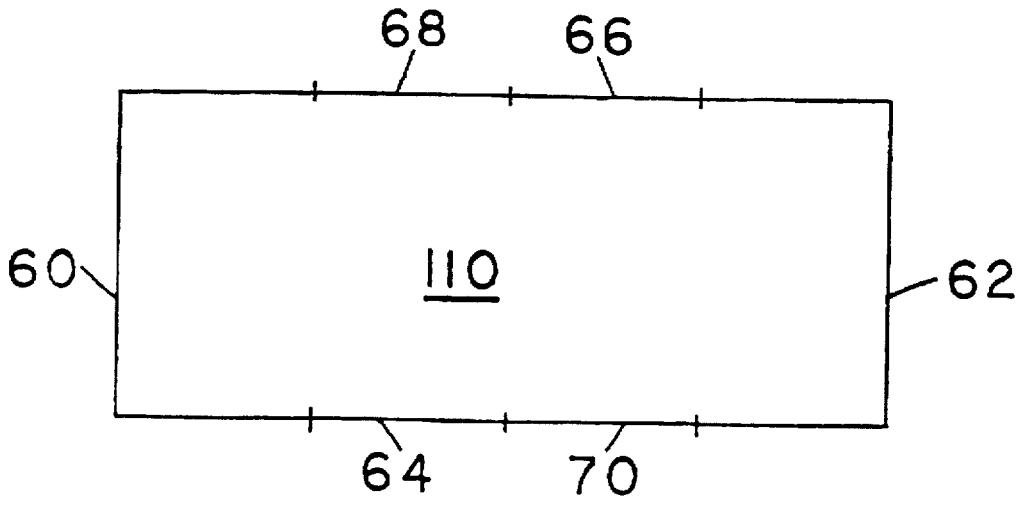
FIG. 14B is a view showing court areas being detected for the remainder of the point, once serve is in play.
Figure 15A:
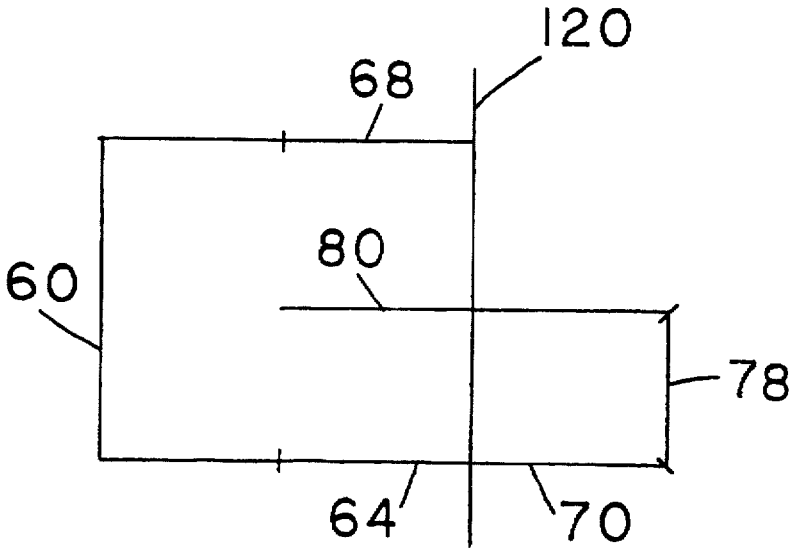
FIG. 15A is a view of the second service position. Including shown court areas currently being detected.
Figure 15B:
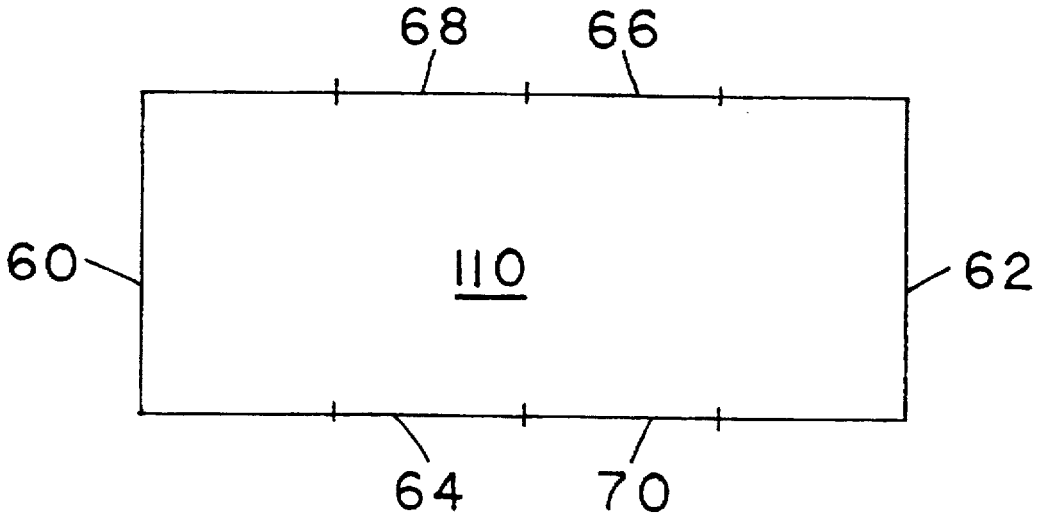
FIG. 15B is a view showing court areas being detected for the remainder of the point, once serve is in play.
Figure 16A:
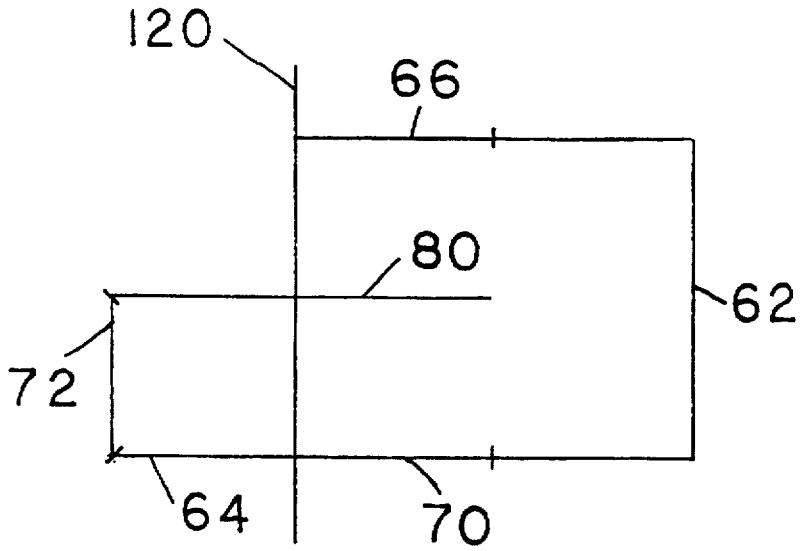
FIG. 16A is a view of the third service position. Including shown court areas currently being detected.
Figure 16B:
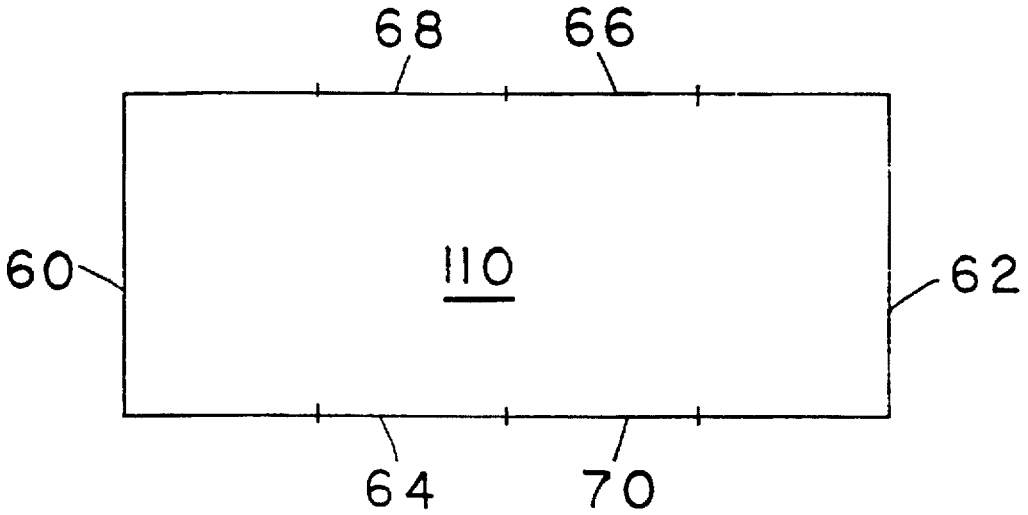
FIG. 16B is a view showing court areas being detected for the remainder of the point, once serve is in play.
Figure 17A:
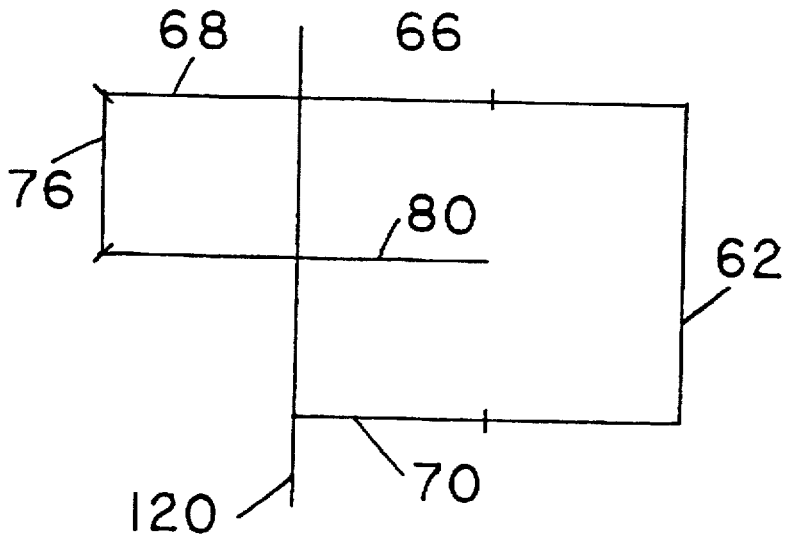
FIG. 17A is a view of the fourth service position. Including shown court areas currently being detected.
Figure 17B:
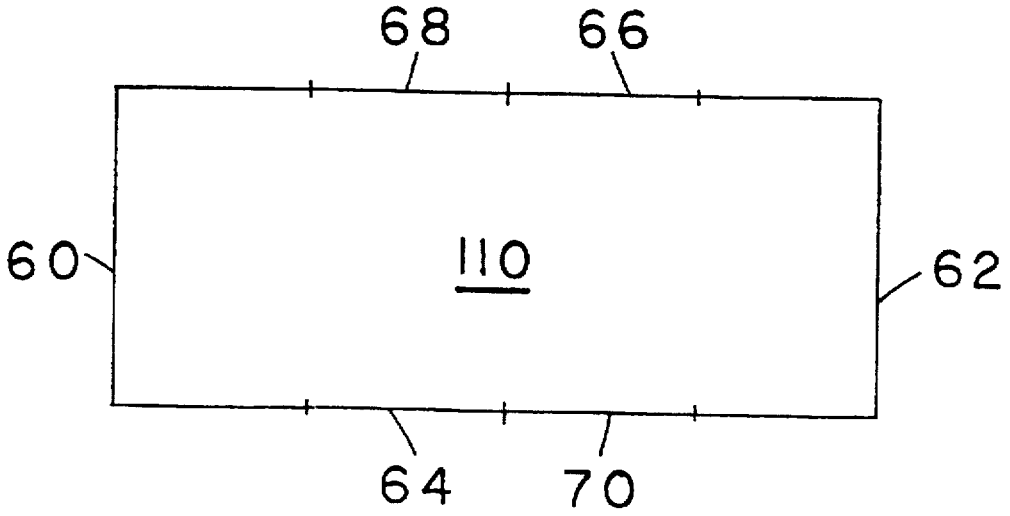
FIG. 17B is a view showing court areas being detected for the remainder of the point, once serve is in play.
Figure 19:
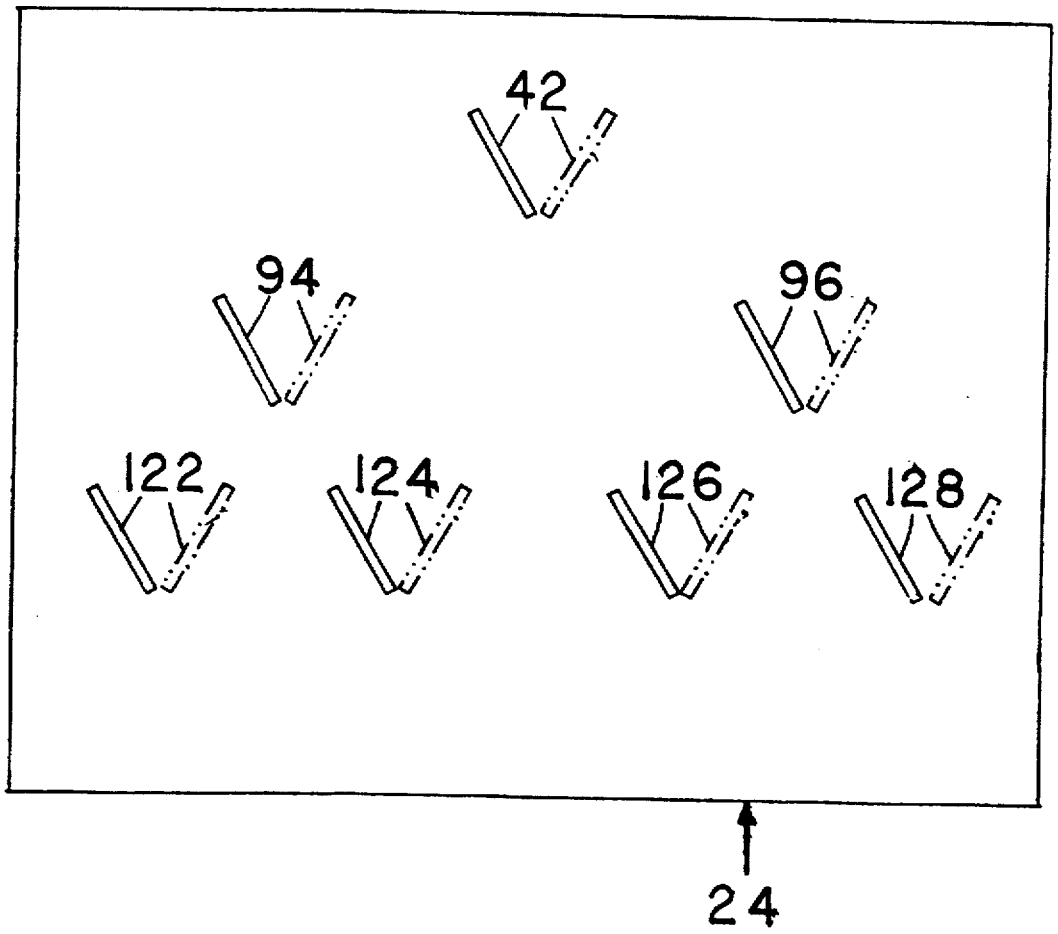
FIG. 19 is a diagram of control box.

The manner of using the tennis court boundary detection system to differentiate the court areas during specific points of a match, will become more apparent now with attention toward figures included above. Namely, the first service position shown in FIG. 14A includes detail of active open circuits when serving from the left court into the right deuce court. In FIG. 19, diagram of control box 24, with first service position switch 122 in on position, the following open active circuits will be on. FIG. 14A shows circuits LSB&SL' 60, LDSL 64, RDSL 66, LASL 68, and RDL 74 in active open state. This activates servers baseline and sidelines, and returners service lines. The odds of a server hitting a serve into the court he is serving from (the left court) and it being determined good is non-existent, thus the servers baseline and sidelines will stay active for detection of the return of serve. Once the serve has commenced the point the operator will change switch position and turn off the returners service lines and turn on the returners baseline and sidelines, FIG. 14B, thus activating both baselines and sidelines until completion of point. The reason that all lines can not remain in active open state is that long serves on the returners sideline and wide serves into the opposite service court must not be detected as a good shot, thus the apparent reason for manual operation of control box 24.

Operation of the three remaining service positions are identical to that for first service position, aside from the use of second, third, and fourth service position switches respectively. Illustrated in FIGS. 15, 16, and 17, the A diagram shows the service position, and the B diagram shows the baselines and sidelines until completion of point. These include FIG. 15A–B, coupled to FIG. 19 switch #2 124, FIG. 16A–B, coupled to switch #3 126, FIG. 17A–B, coupled to switch #4 128. Other switches on control box 24 include ON/OFF switch 42, doubles courts switch 94, for doubles play, and audio/remote switch 96, for audible speaker, or remote hearing aid for use by officials.

SUMMARY, RAMIFICATIONS, and SCOPE

Accordingly, the reader will see that the limited size of the court detection means, along with the limited court area to be detected will improve reliability, at the same time it will preserve the human element. Preserving the human is a vital factor and previously not recognized in prior attempts. The sport of tennis has deep tradition and is unwilling to change or modify its method of officiating. In addition, prior attempts have had no regard toward the human element, and are attempting to re-write the officiating process altogether. Furthermore, the system proposed has the additional advantages in that

- it permits the officiating crews to do their normal jobs without the intimidation factor that their function will be eliminated entirely by an automated system that proposes detecting at least two feet outside and two feet inside the court boundary, thus solving a previously unrecognized problem;
- it permits the sport of tennis to adopt a concept that will not interfere with the flow of match play without rewriting the rule book and changing the method of officiating with one major advancement;
- it allows lines people to assume control of the match by having an aid which becomes apparent only on those calls where much doubt occurs i.e. optically impossible to detect;
- it provides a system superior to prior technology by keeping it simple by omitting complex logic circuits, at the same time instituting accuracy, inviting infallibility, and producing durability.
- it provides a system that can not be over-ruled by the same thing in which the current systems are trying to eliminate i.e. human line calls on shots that are impossible to humanly detect.
- it provides a system that will not change or alter the surface texture, that is it duplicates the same texture as the court surface.
- it provides a system that is inconspicuous to the players;
- it provides a system which acknowledges the opinions of all authorities involved in acceptance and utilization of such a system;
- it provides a system which respects the preservation of the human official with considerations of gradually accruing and modifying detection easily adapted when the human element becomes more and more out-of-trend, and automation more and more the demand;
- it satisfies the officials attempt to call a perfect match, thus eliminating embarrassment from challenging players;

it satisfies the players quest to honestly know whether a shot has tagged the boundary line, thus allowing them to keep their concentration and proceed on with the current point, or move on to the next point;

it resolves a controversy that currently stands unresolved;

it is introduced after previous others have failed; and it meets all economical objections by costing about 15 to 20% of the actual court itself, and lasting the life of the court.

Although the description above contains many specificities, these should not be construed as limiting the scope of the invention but as merely providing illustrations of some of the presently preferred embodiments of this invention. For example, the court detection system can have other shapes, such as thinner or thicker or narrower or wider circuits exposed to the surface, or more than one circuit in parallel detecting the balls. Also the court detection means may consist of other types of conductive and insulating materials, not to be construed as limiting the original intent of the invention.

Thus the scope of the invention should be determined by the appended claims and their legal equivalents, rather than by the examples given.

I claim:

1. An electronic detection system for a playing surface which has boundaries, comprising:

(a) an installed body of material comprising no less than one exposed edge of no less than one said body of material comprising no less than two pieces of conductive buss bar, and (b) said bar sandwiches an insulator of the same dimensions forming said body of material, and (c) said playing surface comprises non-porous concrete material, and (d) no less than one groove is cut in and extends the full length of said boundaries of said playing surface.

2. A system according to claim 1 comprising said body of material is elongated and extended the full length of said boundaries.

3. A system according to claim 2 wherein said material may be located at furthest outside edge of said boundaries and is added in intervals inward thereof, thereby detecting balls in-play.

4. A system according to claim 1 comprising electronic connector means thereby transmitting an external signal to a remote hearing aid means for official attended matches.

5. A system according to claim 4 further including an audible means for matches officially unattended.

6. A system according to claim 5 including a programmable logic controller for manual operation of different court area detection during designated segments of the match.

7. A system according to claim 1 additionally including an electronically conductive felt nap means for an officially approved tennis ball.

8. A system according to claim 7 further comprising an electronically conductive fiber blended in a predetermined amount thereby giving said tennis ball durability and making fiber difficult to recognize with an unaided eye.

9. An electronic detection system for a gaming surface which has boundary lines, comprising:

(a) a permanently installed body of material including no less than one exposed edge of no less than one said body of material including no less than one conductive buss bar, and (b) said bar borders an insulator means forming said body of material installed in a cut groove in said gaming surface.

10. A system according to claim 9 wherein no less than one said body of material is elongated and continues the full length of said boundary lines.

11. A system according to claim 9 further comprising no less than one elongated and longitudinal said cut groove in said boundary lines of said playing surface comprising a concrete material playing surface.

12. A system according to claim 9 including connector means wherein said connector means transmits external signal means to audio means further including hearing aid means for chair umpire and linespeople during attended matches.

13. A system according to claim 12 further comprising programmable logic controller means for court area detection during match play.

14. A system according to claim 9 comprising electronically conductive felt nap means for tennis ball.

15. A system according to claim 14 further comprising conductive fibers partly present which are conductive in their entirety and said conductive fibers in a predetermined amount are not recognizable with unaided eye and contains physical properties of official tennis ball.

16. An electronic arrangement for a gaming surface which has boundary lines, comprising:

(a) a permanently installed detection body including no less than one exposed edge of no less than one said detection body comprising a conductive buss bar, and (b) said bar sandwiches insulator forming said detection body installed in a cut groove in said gaming surface.

17. A system according to claim 16 wherein said detection body is elongated and extends the full length of said boundary lines wherein initial said detection body is located at the furthest outside edge of said boundary lines and continues in intervals inwards and outwards from said boundary lines.

18. A system according to claim 17 including a hardcourt surface material comprising a groove cut in said boundary lines of said hardcourt surface material.

19. A system according to claim 16 comprising a programmable logic controller means for manual operation of different court area detection.

20. A system according to claim 16 including electronically conductive fiber means blended with felt nap for officially approved tennis ball.

* * * * *